United States Patent [19]

Ito et al.

[11] Patent Number: 4,924,264

[45] Date of Patent: May 8, 1990

[54] IMAGE DUPLICATING APPARATUS HAVING EDITED COPYING MODE

[75] Inventors: Masazumi Ito; Kimihiko Higashio, both of Aichi, Japan

[73] Assignee: Minolta Camera Kabushiki Kaisha, Osaka, Japan

[21] Appl. No.: 135,251

[22] Filed: Dec. 21, 1987

[30] Foreign Application Priority Data

Jun. 30, 1987 [JP] Japan ..... 62-164584
Jun. 30, 1987 [JP] Japan ..... 62-164585
Jun. 30, 1987 [JP] Japan ..... 62-164586

[51] Int. Cl.[5] ..... G03G 21/00

[52] U.S. Cl. ..... 355/204; 355/208; 355/218

[58] Field of Search ..... 355/4, 7, 40, 202, 208, 355/218, 204

[56] References Cited

U.S. PATENT DOCUMENTS 4,618,883 10/1986 Sakamoto ..... 358/78
4,653,899 3/1987 Watanabe ..... 355/14
4,707,110 11/1987 Harada et al. ..... 355/7
4,720,729 1/1988 Watanabe ..... 355/14
4,724,464 2/1988 Umeda et al. ..... 355/40
4,734,789 3/1989 Smith et al. ..... 355/202 X
4,742,373 5/1988 Nakatani ..... 355/7 X
4,750,212 6/1988 Yokomizo ..... 382/56

*Primary Examiner*—A. T. Grimley
*Assistant Examiner*—Ed Pipala
*Attorney, Agent, or Firm*—Burns, Doane, Swecker & Mathis

[57] ABSTRACT

An image duplicating apparatus having an edited mode of copying operation in which an edited copy of a given image is to be produced, wherein editing data indicative of any desired conditions of operation in which the edited mode of copying operation is to be executed for a desired edited copy area may be entered by the operator in any desired manner after area data indicative of the desired edited copy area in which images are to be reproduced in the edited mode of copying operation has been entered under the edited mode of copying operation.

17 Claims, 16 Drawing Sheets

200
202
START
204
206
208
C/S
210
IR
212
SZ
214
M/R
214a
212a
216
UP
216a
218
DN
1
2
3
4
5
6
7
8
9
0
A3
B4
A4
B5
A3 ▷ A4
A4 ▷ A5
B4 ▷ B5
A3 ▷ A4
B4 ▷ A4
A4 ▷ B5
A4 ▷ A3
A5 ▷ A4
B5 ▷ B4

EDITING INPUT
MEMORY 1
MEMORY 2
MEMORY
224
222
226
232
230
228
236
234

START A03

C01
SEC = 1
NO
YES
C02
Fs = 12
NO
C
YES
C03
224a ON
NO
YES
C05
224b ON
NO
YES
C07
224c ON
NO
YES
C09
224d ON
NO
YES
STORE Xa1
C04
STORE Xb1
C06
STORE Yc1
C08
STORE Yd1
C10
C11
STORE NP
RETURN

START B01
D01
SEC = 1
NO
YES
D02
222a ON
NO
YES
D15
TURN ON 222a
D03
Fs = 0, 11
NO
D05
Fs = 12, 16
NO
D06
D16
Fs ← 11
YES
D04
SEC ← 0
YES
Fs ← 17
NO
FLICKER 228a, 230a
D17
YES
D07
NO
228a ON
YES
D08
Fs ← 11
Fs ← 16
D12
D09
FLICKER 228a, 230a
FLICKER 230a, 232a
D13
D10
TURN OFF 228b-228d
TURN OFF 230b-230d
D14
TURN OFF 224a-224d
D11
RETURN

IMAGE DUPLICATING APPARATUS HAVING EDITED COPYING MODE

FIELD OF THE INVENTION

The present invention relates to an image duplicating apparatus and particularly to an electrophotographic image duplicating apparatus such as a copying apparatus of the type having edited image forming and data input capabilities. More particularly, the present invention relates to an electrophotographic image duplicating apparatus having an edited mode of copying operation in which images within any one or more of a plurality of designated copy areas may be copied and printed in any color or colors or may be blanked out or "erased".

BACKGROUND OF THE INVENTION

An electrophotographic copying apparatus having edited image forming and data input capabilities is known which has an edited mode of copying operation in which images of a given document can be copied and printed in a plurality of colors. An advanced version of such a copying apparatus further allows designation of one or more localized areas so that the images within any one or more of the designated areas may be copied and printed in any desired color or colors or may be erased. In a copying apparatus of this type, whether the images within a designated area are to be printed or erased and whichever of the colors available is to be used for printing may be determined subsequently to the designation of the coordinates defining the desired edited copy area.

In carrying out such an edited mode of copying operation, coordinate data to define a desired edited copy area and instructions to print or erase the images within the area are entered successively before the copying operation is to be started. There may be cases where, for example, it is desired to change the printing color from red (magenta) to black or conversely from black to red for one or more designated areas or where it is desired to have a designated area printed in a desired color after an instruction has been entered to erase the particular area. Laborious and time-consuming efforts are thus required for the operator to enter the coordinate data for the desired edited copy area or areas each time it is desired to make such a change.

In using a copying apparatus having the multi-colored edited mode of copying operation, the operator may desire to carry out the edited mode of copying operation using the data which have already been entered for the previous copying operation. The operator may otherwise desire to use additional data or partially modify the previously entered data for the edited mode of copying operation.

SUMMARY OF THE INVENTION

The present invention contemplates elimination of these and other problems which have thus far been inherent in an image duplicating apparatus of the described type. It is, accordingly, a prime object of the present invention to provide an image duplicating apparatus of the described type improved to provide ease of manipulation for the copying operation in an edited multi-colored mode.

In accordance with the present invention, there is provided an image duplicating apparatus having an edited mode of copying operation, comprising (a) image forming means for producing an edited copy of a given image; (b) mode selecting means for selecting the edited mode of copying operation; (c) area designating means for designating an edited copy area in which images are to be copied in the edited mode of copying operation; (d) data input means for entering data indicative of the particulars in accordance with which the edited mode of copying operation is to be executed for the designated edited copy area; and (e) control means for allowing entry of data from the data input means in any desired manner after the edited copy area has been designated by the area designating means, provided the edited mode of copying operation is selected.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENT

Figure 1:
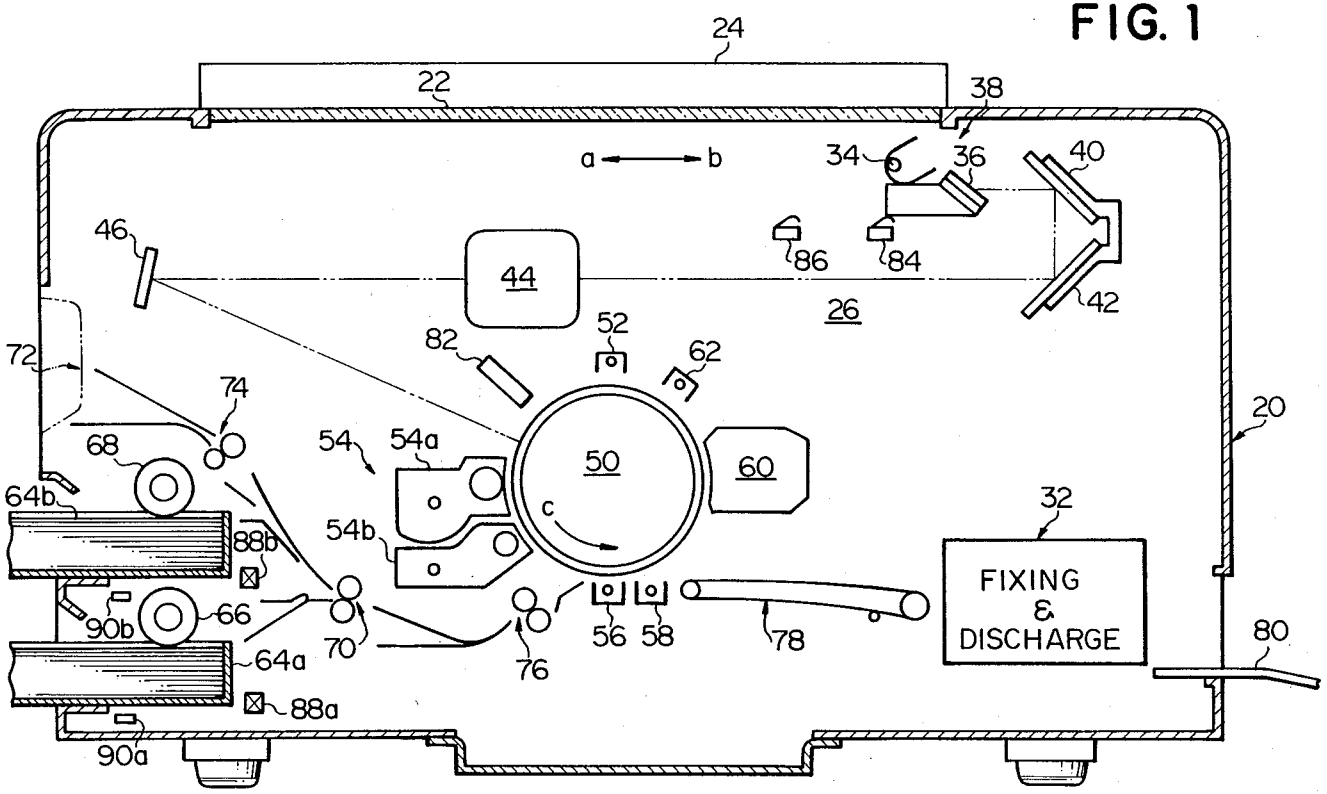
FIG. 1 is a side elevation view showing the general mechanical construction and arrangement of a preferred embodiment of an image duplicating apparatus according to the present invention.

As shown in FIG. 1, an image duplicating apparatus (hereinafter referred to as copying apparatus) embodying the present invention comprises a housing 20 having an upper panel portion provided in part by a transparent document table 22. A sheet of document sheet (not shown) bearing images to be reproduced is to be placed on this document table 22. Indicated at 24 is a document retainer lid which is to be opened up from or closed down to the document table 22 so that the document sheet placed on the document table 22 is retained on the surface of the table 22 during copying operation.

During copying operation of the apparatus, the document sheet thus retained on the document table 22 is optically scanned by illumination with light from an optical scanning system 26. A resultant beam of light carrying information representative of the images on the scanned document sheet is directed to an image reproduction system 28. The images thus carried by the light beam are provisionally recorded in the form of latent images, which are then developed into visible images through an electrophotographic process performed by the image reproduction system 28. The visible images are transferred to any record medium such as typically a copying sheet transported by a copy sheet feed mechanism 30 and the copy sheet now carrying the reproduced images is withdrawn from the apparatus by means of an image-fixing and sheet discharge system 32.

The optical scanning system 26 is of the slit exposure type and comprises an exposure lamp 34 from which a beam of light is incident on and reflected from the lower face of the document sheet on the table 22. The light reflected from the document sheet is incident onto an object mirror 36 and is re-directed rearwardly therefrom. The lamp 34 and object mirror 36 are carried on a common movable support member and implement a document scanner 38 in the apparatus embodying the present invention. The document scanner 38 is movable forwardly along the document table 22 as indicated by arrow a and backwardly as indicated by arrow b and has a predetermined home position with respect to the document table 22. The light reflected from the object mirror 36 is re-directed toward a mirror 40, which further re-directs the light downwardly toward another mirror 42. The mirror pair 40/42 is also carried on a common movable support member and is movable along the document table 22 into and out of a predetermined home position with respect to the table 22. The document scanner 38 and mirror pair 40/42 are operatively coupled to common drive means comprising a scanner drive motor (not shown) implemented by a d.c. reversible motor so that the former is driven to travel at a speed doubling the speed of movement of the latter. From the mirror 42, the light travels forwardly along the document table 22 and is passed through an image magnification/reduction lens unit 44 to a projecting mirror 46. The lens unit 44 is movable along the document table 22 independently of the document scanner 38 and mirror pair 40/42 with respect to the table 22. The lens unit 44 is thus operatively coupled to drive means comprising a lens drive motor (not shown) which may be implemented by a d.c. stepper motor. The projecting mirror 46 re-directs the light downwardly and rearwardly toward the image reproducing system 28 as shown. The projecting mirror 46 is normally fixedly held in place with respect to the housing 20 but is moved and swung when a change is made in the magnification ratio to compensate for the length of the effective optical path.

On the other hand, the image reproducing system 28 of the apparatus comprises a cylindrical drum 50 having a photoconductive peripheral surface. The drum 50 is rotatable about its center axis in a direction indicated by arrow c and is driven for rotation at a fixed peripheral speed (V) by a main drive motor (not shown) of the apparatus which may be provided independently of the scanner and lens drive motors. The light reflected downwardly from the projecting mirror 46 is projected onto the peripheral surface of this drum 50 which is driven for rotation in a direction indicated by arrow c. Movement of the lens unit 44 in either direction with respect to the mirror 46 results in a change in the position of the unit 44 with respect to the peripheral surface of the drum 50 and accordingly in a change in the magnification/reduction ratio (N, hereinafter referred to simply as magnification ratio) of the images to be reproduced. The document scanner 38 and mirror pair 40/42 of the optical scanning system 26 are driven for movement each in the direction of arrow a at speeds related to the peripheral speed of rotation V of the drum 50 and the magnification ratio N provided by the lens unit 44. In the apparatus herein shown, it is assumed by way of example that the document scanner 38 is driven for movement at a speed V/N and the mirror pair 40/42 at a speed V/2N as are customary in the art.

The image reproducing system 28 further comprises a main charger 52 to sensitize the photoconductive peripheral surface of the drum 50. Posterior to the path of light from the mirror 52 to the drum 50 is located an image developing stage 54 which is herein shown as including two, upper and lower developing units **54*a* and 54*b* detachably mounted in the apparatus and each having a stock of a developer powder composed of a mixture of electrostatically charged carrier particles and black or otherwise colored toner particles. In the image developing stage 54 is provided a drive motor (not shown) by means of which the rotatable members forming part of each of the developing units 54*a* and 54*b* are to be driven for rotation for applying toner particles to the peripheral surface of the drum 50 from a selected one of the developing units 54*a* and 54*b***, as will be described in more detail.

Posterior to the developing stage 50 in turn is provided an image transfer charger 56 which is operative to charge the copy sheet so that the toner images formed on the drum 50 are transferred to the copy sheet. The copy sheet thus having the toner images carried thereon is cleared of charges by a separation charger 58 which is located posterior to the transfer charger 56. There is further provided a drum cleaner unit 60 which removes any residual toner particles from the peripheral surface of the drum 50. Posterior to this cleaner unit 60 in turn is located a charge eraser lamp 62 which irradiates the cleaned peripheral surface of the drum 50 to eliminate the charges which may be left thereon.

The paper feed mechanism 30 is provided in conjunction with first and second paper supply cassettes **64*a* and 64*b* detachably fitted to the housing 20 and which respectively have stocks of copy sheets of different sizes encased therein. The paper feed mechanism 30 per se comprises first and second paper feed rollers 66 and 68 associated with the cassettes 64*a* and 64*b*, respectively. Each of these rollers 66 and 68 is driven for rotation for picking up copying sheets one after another from the stack of paper in the associated one of the cassettes 64a and 64b. A copying sheet picked up from either the first paper supply cassette 64a or the second paper supply cassette 64b by means of the paper feed roller 66 or 68, respectively, is passed through a first pair of guide rollers 70 toward the drum 50. There is further provided a manual paper feed slot 72 so that a copying sheet may be manually inserted into the housing 20 through the slot 72. The copying sheet thus inserted manually through the slot 72 is transported toward the first pair of guide rollers 70 via a second pair of guide rollers 74**.

Immediately anterior to the image transfer charger 56 is provided a pair of timing rollers 76. A copying sheet which has been transported toward the drum 50 through the first pair of guide rollers 70 or through the second and first pairs of guide rollers 74 and 70 is brought into contact with the peripheral surface of the drum 50 by means of these timing rollers 76. The timing rollers 76 are driven for rotation at a timing synchronized with the movement of the document scanner 38 so that the toner images on the peripheral surface of the drum 50 are correctly transferred to the copying sheet. The timing rollers 76 are further operative to rectify the direction of the copying sheet to be fed to the peripheral surface of the drum 50. Each of the first and second paper feed rollers 66 and 68, each of the first and second pairs of guide rollers 70 and 74, and the timing rollers 76 are driven from the main drive motor of the apparatus by means of respectively associated clutches (not shown).

A copy-sheet transport belt assembly 78 is positioned posterior to the area where the copy sheet is to be separated from the drum 50. The copy sheet separated from the drum 50 is thus conveyed rearwardly through the belt assembly 78 to the image-fixing and sheet discharge system 32 provided at the rear of the belt assembly 78. The toner particles carried on the copy sheet are thermally fused to form toner images fixed on the copy sheet by means of this image-fixing and sheet discharge system 32. The copy sheet released from this system 32 is withdrawn from the apparatus through to a paper discharge tray 80 attached to the housing 20 through a slot provided in the rear panel portion of the housing 20.

The copying apparatus embodying the present invention has capabilities to reproduce images in an edited mode within a specified area of a copying sheet. Such an edited mode of operation is effected with use of an eraser unit 82 located posterior to the main charger 52 and anterior to the developing stage 54 with respect to the path of light from the projecting mirror 46 to the peripheral surface of the drum 50. If desired, however, the eraser unit 82 may be located posterior to the path of light from the projecting mirror 52 to the drum 50. The terms "posterior" and "anterior" herein referred to in connection with the eraser unit 82 indicate the location of the eraser unit 82 with respect to the direction of rotation indicated by arrow c of the drum 50.

Though not shown in the drawings, the eraser unit 82 is composed of a number of light emitter elements arranged in a single linear array as well known in the art. The linear array of the light emitter elements is positioned close to the peripheral surface of the drum 50 and extends in parallel to the axis of rotation of the drum 50. When the light emitter elements of such an eraser unit 82 are activated to illuminate selectively with the drum 50 being driven for rotation, the charges on those small areas of the drum surface which are illuminated by the selected light emitter elements are caused to disappear. Accordingly, no latent images can be produced on the particular areas of the drum surface when the drum surface is irradiated with an information carrying beam. It will be apparent that, where the eraser unit 82 is located posterior to the path of light to the peripheral surface of the drum 50, the latent images which have once been produced on the drum surface are to be destroyed by irradiation from the selected ones of the light emitter elements. Each of the light emitter elements of the eraser unit 82 is implemented typically by a light emitting diode (LED).

The apparatus embodying the present invention further comprises various sensors and detectors which include a home position sensor 84 and a scan timing sensor 86 located in conjunction with the document scanner 38. The home position sensor 84 is responsive to the predetermined home position of the document scanner 38 with respect to the document table 22 and is operative to produce a home position signal $S_{HP}$ of a logic "1" bit when the document scanner 38 stays in the home position thereof. The scan timing sensor 86 is responsive to the movement of the document scanner 38 with respect to the document table 22 and is operative to produce a scan timing signal $S_{ST}$ of a logic "1" bit at a predetermined point of time after the document scanner 38 is moved from its home position. The scan timing signal $S_{ST}$ of logic "1" bit is predominant over the timing at which the timing rollers 76 are to be initiated into motion.

The sensors and detectors of the apparatus further include first and second paper size sensors 88a and 88b arranged in conjunction with the first and second paper supply cassettes 64a and 64b, respectively, of the paper feed mechanism 30. Each of the paper supply cassettes 64a and 64b has attached thereto a magnet element (not shown) located specifically to the particular cassettes to enable the associated sensor 88a or 88b to discriminate one of the cassettes 64a and 64b from the other depending on the locations of the magnet elements on the cassettes 64a and 64b. Indicated at 90a and 90b are sensors to detect the conditions in which there are no copying sheets stored in the first and second paper supply cassettes 64a and 64b, respectively.

Figure 2A:
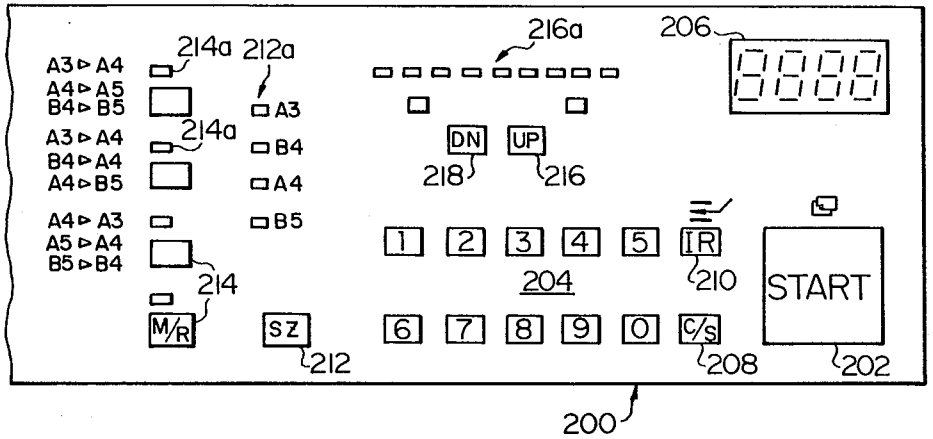
FIGS. 2A and 2B are fragmentary plan views schematically showing in combination the general configuration of the control panel forming part of the image duplicating apparatus illustrated in FIG. 1.
Figure 2B:
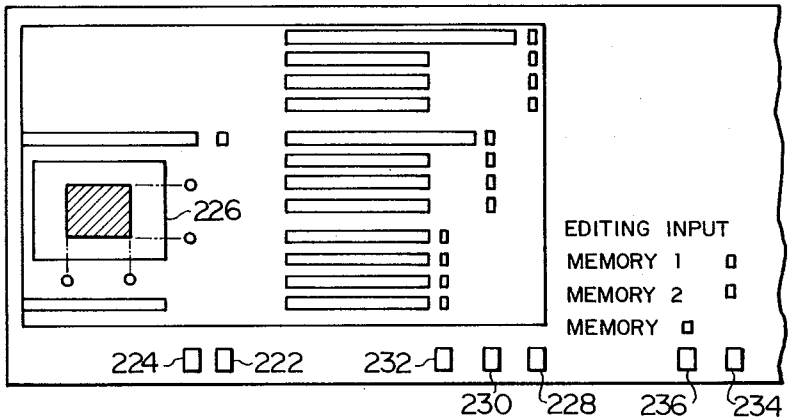

FIGS. 2A and 2B shows the general configuration of a control panel 200 which forms part of the apparatus embodying the present invention. Referring to FIG. 2A, the control panel 200 comprises a print start switch 202 to enable the apparatus to start duplicating operation and a set of numerical switches 204 allocated to numerals 1, 2, . . . and 0, respectively and used to enter a selected quantity of copy sheets to be printed. The quantity of copy sheets thus entered from the numerical switches 204 is displayed on a numerical data display window 206 and can be cleared from a clear/stop switch 208 (C/S) which may be used also for cancelling the instruction once entered from the print start switch 202. During printing of a preset quantity of copy sheets for a given document sheet, another document sheet may be duplicated in an interrupt mode entered at an interrupt request switch 210 (IR). The numerical switches 204 are to be used not only for entering a selected quantity of copy sheets to be printed but for numerical data representative of the coordinates to define a desired edited copy area to be specified during an edited copying mode of operation. The numerical data thus entered from the switches 202 are also displayed on the numerical data display window 206.

The size of copy sheets to be used can be selected at a manual paper-size select switch 212 (SZ) from among a predetermined number of sizes available. The selected size of copy sheets is displayed by any of paper-size indicators which are collectively indicated at 212*a*. By way of example, these paper size indicators 212*a* are assumed to be assigned to the standardized A3, B4, A4 and B5 sizes, respectively, as shown. The paper-size select switch 212 is, in effect, operative to select of the paper supply cassettes 64*a* and 64*b* currently installed on the apparatus shown in FIG. 1. In the control panel 200 are further provided a set of magnification/reduction ratio select-switches 214 for selecting any one of predetermined magnification ratios for copying, the switches 214 having respectively associated indicators 214*a*. Further provided are print density increment and decrement switches 216 and 218 with respectively associated indicators 216*a* to permit manual selection of a desired print density for the images to be printed. The print density is stepwise incremented with one of the switches 216 and 218 depressed or is stepwise decremented with the other of the switches depressed.

Figure 2C:
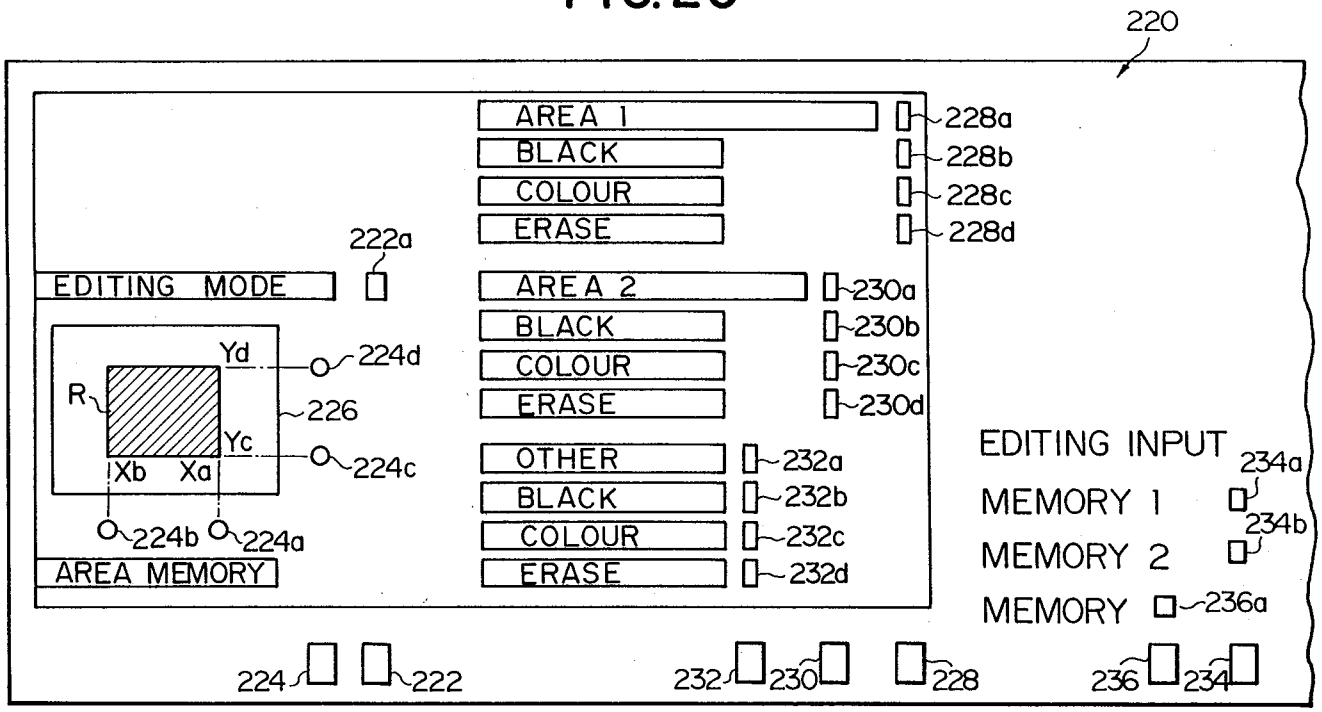
FIG. 2C is a fragmentary plan view showing to an enlarged scale an edited copying mode control section forming part of the control panel illustrated in FIGS. 2A and 2B.

The control panel 200 further has an edited copying mode control section 220 illustrated in FIG. 2B and to an enlarged scale in FIG. 2C. The edited copying mode control section 220 include an edited copy mode select switch 222 for enabling the apparatus to select an edited copying mode of operation. When the edited copy mode select switch 222 is depressed to select the edited copying mode of operation, there is produced an edited copy mode request signal $S_{EC}$ with a logic "1" flag bit. The switch 222 has an associated indicator 222*a* which is to be turned on to illuminate in the presence of the edited copy mode request signal $S_{EC}$. Further provided in the section 220 is an area data enter switch 224 for entering the x- and y-coordinates of a desired edited copy area. In association with this area data enter switch 224 are arranged first to fourth indicators which consist of two x-coordinate indicators 224*a* and 224*b* and two y-coordinate indicators 224*c* and 224*d*. To provide a visible assistance to the designation of the coordinates of such a copy area through the switch 224, there is further provided in the section 220 an area display screen 226 on which a desired edited copy area R to be printed or erased is to be visually indicated. An xy-coordinate system is thus taken into account on this area display screen 226 as having an axis of abscissa corresponding to the direction of circumferential direction of the drum 50 and an axis of ordinate corresponding to the axial direction of the drum 50, with an origin at the right lower corner of the screen 226. The desired edited copy area R can thus be defined by the combination of x-coordinates $X_a$ and $X_b$ and y-coordinates $Y_c$ and $Y_d$ which may be designated from any of the numerical switches 204 and entered from the area data enter switch 224. The coordinates $X_a$, $X_b$, $Y_c$ and $Y_d$ may be designated one after another as the coordinate indicators 224*a* and 224*b* for the x-coordinates $X_a$ and $X_b$ and the coordinate indicators 224*c* and 224*d* for the y-coordinates $Y_c$ and $Y_d$, respectively, are turned on to illuminate successively. Each of the indicators thus provided on the control panel 200 is of the type using a light emitting diode (LED).

In the copying apparatus according to the present invention, it is assumed that there may be specified and displayed on the area display screen 226 two different edited copy areas of a copying sheet. These two edited copy areas will be herein referred to as "edited copy area 1" or simply as "area 1" and "edited copy area 2" or simply as "area 2" and the remaining area surrounding these areas 1 and 2 referred to as "outside area". The area R shown displayed on the area display screen 226 is thus assumed to be representative of one of such two edited copy areas 1 and 2. The images in each of the edited copy areas 1 and 2 or the outside area of a copying sheet may be printed in any of two colors available or may be blanked out or erased. The selection between the two colors or the selection of the erasure of any one or more of the three areas can be entered through an area-1 data enter switch 228, an area-2 data enter switch 230, and an outside-area data enter switch 232. The area-1 data enter switch 228 has associated first to fourth indicators 228*a* to 228*d*, the area-2 data enter switch 230 has associated first to fourth indicators 230*a* to 230*d*, and an outside-area data enter switch 232 has associated first to fourth indicators 232*a* to 232*d*. The first indicator 228*a* associated with the area-1 data enter switch 228 is turned on when the switch 228 is depressed to close and, likewise, the first indicator 230*a* associated with the area-2 data enter switch 230 is turned on when the switch 230 is depressed to close. The first indicators 228*a* and 230*a* respectively associated with the switches 228 and 230 will thus be referred to as area-1 and area-2 select indicators, respectively. When the outside-area data enter switches 232 is depressed to close, the first indicator 232*a* associated therewith is turned on and will thus be referred to as outside-area select indicator. Each of the second indicators 228*b*, 230*b* and 232*b* associated with the area-1, area-2 and outside-area data enter switches 228, 230 and 232, respectively, is assigned to one of the two printing colors available and is herein assumed to be turned on to illuminate when black is selected as the color for the printing of the area under consideration. Each of the third indicators 228*c*, 23*c* and 232*c* associated with the data enter switches 228, 230 and 232, respectively, is assigned to the other of the two printing colors available and is herein assumed to be turned on to illuminate when red is selected as the color for the printing of the area under consideration. Each of the second indicators 228*b*, 230*b* and 232*b* and each of the third indicators 228*c*, 230*c* and 232*c* associated with the switches 228, 230 and 232, respectively, will thus be referred to as black and red select indicators, respectively. Each of the fourth indicators 228*d*, 230*d* and 232*d* associated with the switches 228, 230 and 232, respectively, is assigned to the selection of the erasure of the area under consideration and is turned on to illuminate when the images in the particular area are to be erased. Each of the fourth indicators 228*d*, 230*d* and 232*d* associated with the switches 228, 230 and 232, respectively, will thus be referred to as erase select indicator.

The data thus entered through the switches 222 and 224 and switches 228 to 232 may be selectively stored into memory areas 1 and 2 (not shown) of a random-access memory through a memory area select switch 234 having associated memory-1 and memory-2 select indicators 234*a* and 234*b*. Three different states consisting of a state selecting the memory area 1, a state selecting the memory area 2, and a state selecting none of the memory areas 1 and 2 are put into effect recursively, in the presence of an active signal produced with the memory area select switch 234 depressed. The data for an edited copy mode of operation are stored into the memory through an edited copy mode data memory switch 236 having an associated indicator 236*a*.

When all the data necessary for an edited copy mode of operation specifying edited copy areas 1 and 2 are stored into the memory, the apparatus performs a first edited mode of copying operation for the edited copy area 1 specified. The latent images created on the peripheral surface of the drum 50 by activation of the main charger 52 are thus erased over the area surrounding the edited copy area 1 by means of the eraser unit 98. The latent images within the edited copy area 1 are then converted into visual toner images with the toner particles applied to the drum surface from the selected one of the developing units 54*a* and 54*b*. The original images on a given document are in this fashion printed within the edited copy area of a copying sheet possibly in one of the two colors available from developing units 54A and 54*b*. The copy paper now bearing the printed images is withdrawn from the apparatus through the image fixing and paper discharge system 32 of the apparatus. After the copy sheet thus bearing the images printed within the area 1 thereof, the copy sheet is inserted into the apparatus through the manual paper feed slot 72. An edited mode of copying operation is carried out for a second time on the copy sheet thus fed into the apparatus for producing printed images of possibly the other of the two available colors within the edited copy area 2 of the sheet. An edited mode of copying operation is thus performed in two successive cycles where two edited copy areas are designated and are to be printed in respectively different colors. It will be apparent that, if only one edited copy area is designated or if the same color is to be used for two edited copy areas, the edited mode of copying operation is performed in a single cycle.

The copying apparatus embodying the present invention may comprise a composite copying system and/or a duplex copying system, though not shown in the drawings. As well known in the art, a duplex copying system is used for producing printed images on the reverse face of a copy sheet which has printed images already produced on its front face. On the other hand, an example of a composite copying system is taught in the copending U.S. patent application Ser. No. 06/883,144 filed July 8, 1986 in the names of Ito et al. Where the apparatus according to the present invention is equipped with such a composite or duplex copying system, the manual paper feed means which is to be used for the latter cycle of edited mode of copying operation for two differently colored edited copy areas may be dispensed with.

Figure 3:
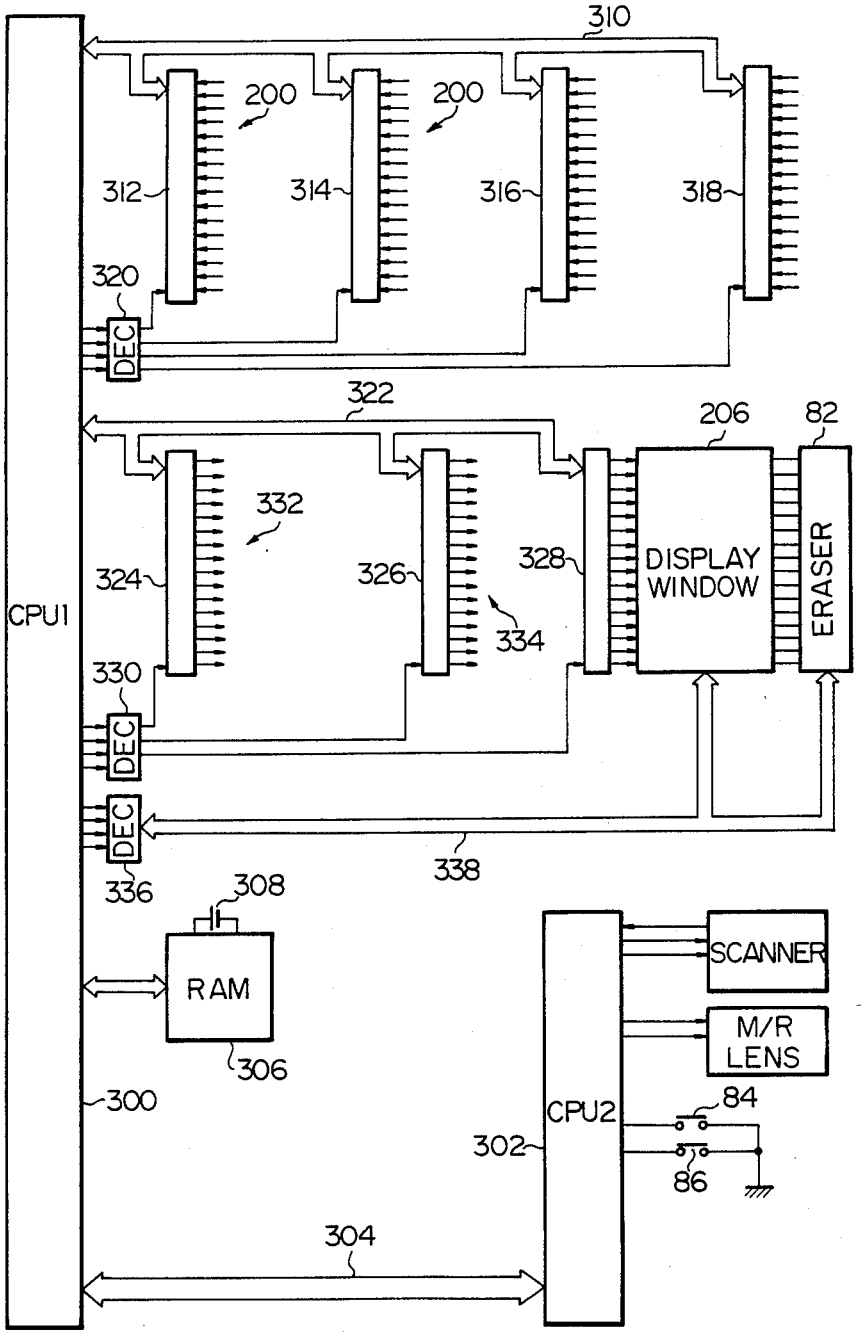
FIG. 3 is a diagram schematically showing the arrangement of a control system which may be incorporated in the image duplicating apparatus embodying the present invention.

FIG. 3 shows the general arrangement of a control system which may be used to achieve the functions hereinbefore described with reference to FIGS. 2A to 2C. The control system comprises first and second microprocessors 300 and 302 (hereinafter referred to as CPU1 and CPU2, respectively) which communicate with each other through a bidirectional bus 304. In association with the first CPU1 is provided a random-access memory 306 (RAM) with a backup power supply source 308. The random-access memory 306 has the previously mentioned memory areas 1 and 2 into which data necessary for executing an edited mode of copying operation are to be stored through the memory area select switch 234 and the edited mode data memory switch 236 provided on the control panel 200 in association with the memory-1 and memory-2 select indicators 234*a* and 234*b*.

The first CPU1 is mainly predominant over the input and output of various signals from and to the control panel 200 and is operative as a master CPU to control the image reproducing system 28, paper feed mechanism 30 and image-fixing and sheet discharge system 32 as required. The first CPU1 is further in control of the edited copy mode of operation of the apparatus to selectively activate the light emitter elements of the eraser unit 82 in response to control and data signals which may be supplied from the edited copying mode control section 220 of the control panel 200. The control and data signals supplied to the CPU1 from the control panel 200 are thus stored in the associated random-access memory 306 and may be processed in accordance with the data and program stored in the CPU1.

The first CPU1 has input terminals connected through a bidirectional data bus 310 to input expander circuits 312, 314, 316 and 318 which include those responsive to signals from the various switches (collectively indicated at 200) including those on the control panel 200. Another input expander circuit associated with the CPU1 is responsive to signals which may be supplied from the paper size sensors 88*a* and 88*b* associated with the first and second paper supply cassettes 64*a* and 64*b*, respectively, of the paper feed mechanism 30. Data and instructions entered from these switches and sensors and thus including those representative of the coordinates of desired edited copy areas 1 and 2 as entered from the numerical switches 204 are thus stored into the random-access memory 306. The expander circuits 312 to 318 have their enable terminals connected through a decoder 320 to the CPU1. The first CPU1 further has output terminals including those connected through a bidirectional address/control bus 322 to output expander circuits 324, 326 and 328 having enable terminals connected through a decoder 330 to the CPU1. One output expander circuit 324 is connected to the driver circuits (herein collectively represented by numeral 332) for the main drive motor, the motor in the developing stage 54, the clutches for the paper feed and timing rollers 66, 68 and 76, the chargers 52, 56 and 58, the eraser lamp 62, and so forth. Another output expander circuit 326 is connected to the various indicators (herein collectively represented by numeral 334) on the control panel 200 including the area display screen 226. A third output expander circuit 328 associated with the CPU1 is connected to the drivers for the numerical data display window 206 and further to the light emitter elements of the eraser unit 82 which are under the control of the CPU1 through a decoder 336 and a bidirectional bus 338. The third output expander circuit 328 under the control of the CPU1 thus implements an eraser control circuit to control the selective activation of the light emitter elements of the eraser unit 82.

The second CPU2 has input terminals connected to the home position sensor 84 and scan timing sensors 86 provided in association with the optical scanning system 26 and is operative to control the driver circuits for the drive motor for the document scanner 38 and the lens drive motor for the magnification lens unit 44. The CPU2 is thus responsive to signals from the home position and scan timing sensors 84 and 86 to regulate the operation of the scanner and lens drive motors of the optical scanning system 26 under the control of the first CPU1 through the bidirectional bus 304. A microprocessor or microprocessors may be further provided to control the duplex and composite copying modes of operation of the copying apparatus if such capabilities are incorporated in the apparatus.

Figure 4:
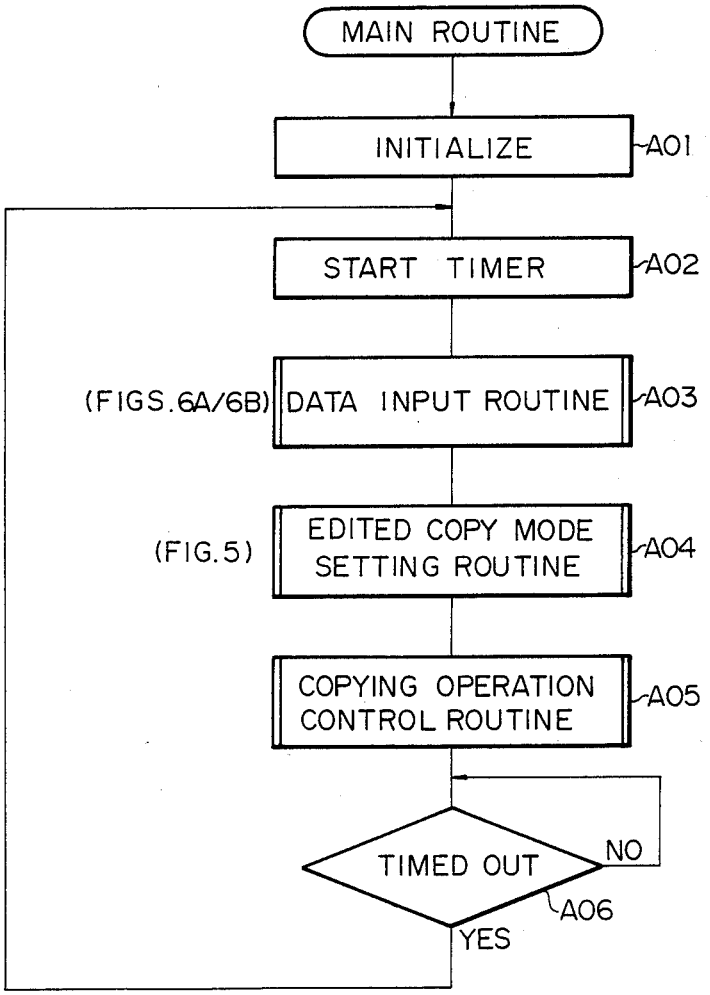
FIG. 4 is a flowchart showing the main routine program to be executed by the control system illustrated in FIG. 3.

FIG. 4 shows the main routine program to be executed by the first CPU1 of the control system hereinbefore described to control the various modes and conditions of operation to be performed by the copying apparatus as a whole. The main routine program of the system starts with the apparatus switched in to initialize the first CPU1 at a step A01 so that all the copying conditions and modes of operation to be controlled by means of the system are selected in accordance with prescribed "default" rules. An internal timer of the system is then started at a step A02 to count the time interval predetermined for a single complete iteration through the routine program.

Routine A03

The first CPU1 may then execute a data input routine program A03 in which the numerical data entered from the numerical switches 204 on the control panel 200 are stored into the random-access memory 306 (FIG. 3) depending on the status of the edited copy mode request signal $S_{EC}$. In the presence of the edited copy mode request signal $S_{EC}$ of a logic "0" flag bit, the numerical data to be stored may be those indicative of the selected quantity of copy sheets to be printed and, in the presence of the signal $S_{EC}$ with a logic "1" flag bit, the numerical data to be stored may be those indicative of the coordinates of a desired edited copy area. The details of this routine program A03 will be described with reference to FIGS. 6A and 6B.

Routine A04

The first CPU1 may further execute an edited copy mode setting routine program A04 to establish various conditions to carry out an edited copy mode of operation. The details of this edited copy mode setting routine program A04 will be described with reference to FIG. 5.

Routine A05

The first CPU1 may further execute a copying operation control routine program A05 which is predominant over most of the major steps of copying operation to be carried out by the apparatus when the print start switch 202 is depressed. The copying operation to be controlled by this routine program A05 may be either in an ordinary copying mode or in an edited copying mode. Such a copying operation control routine program is per se well known in the art and is rather immaterial to the understanding of the gist of the present invention, description regarding the details of the program will not be herein incorporated.

Upon lapse of the predetermined time interval as detected at a step A11 after the internal timer of the system has been started at the step A02, the system reverts to the step A02 and recycles the routine programs A03 to A05.

Edited Copy Mode Setting Routine A04

Figure 5:
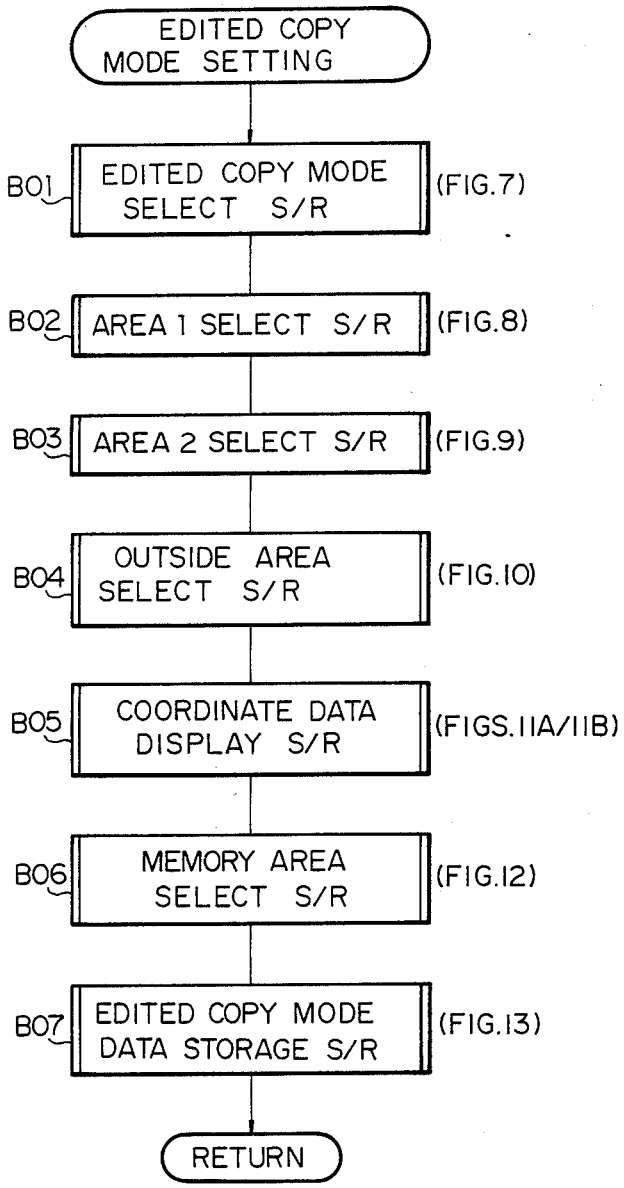
FIG. 5 is a flowchart showing the details of the edited copy mode setting routine program included in the main routine program illustrated in FIG. 4.
Figure 7:
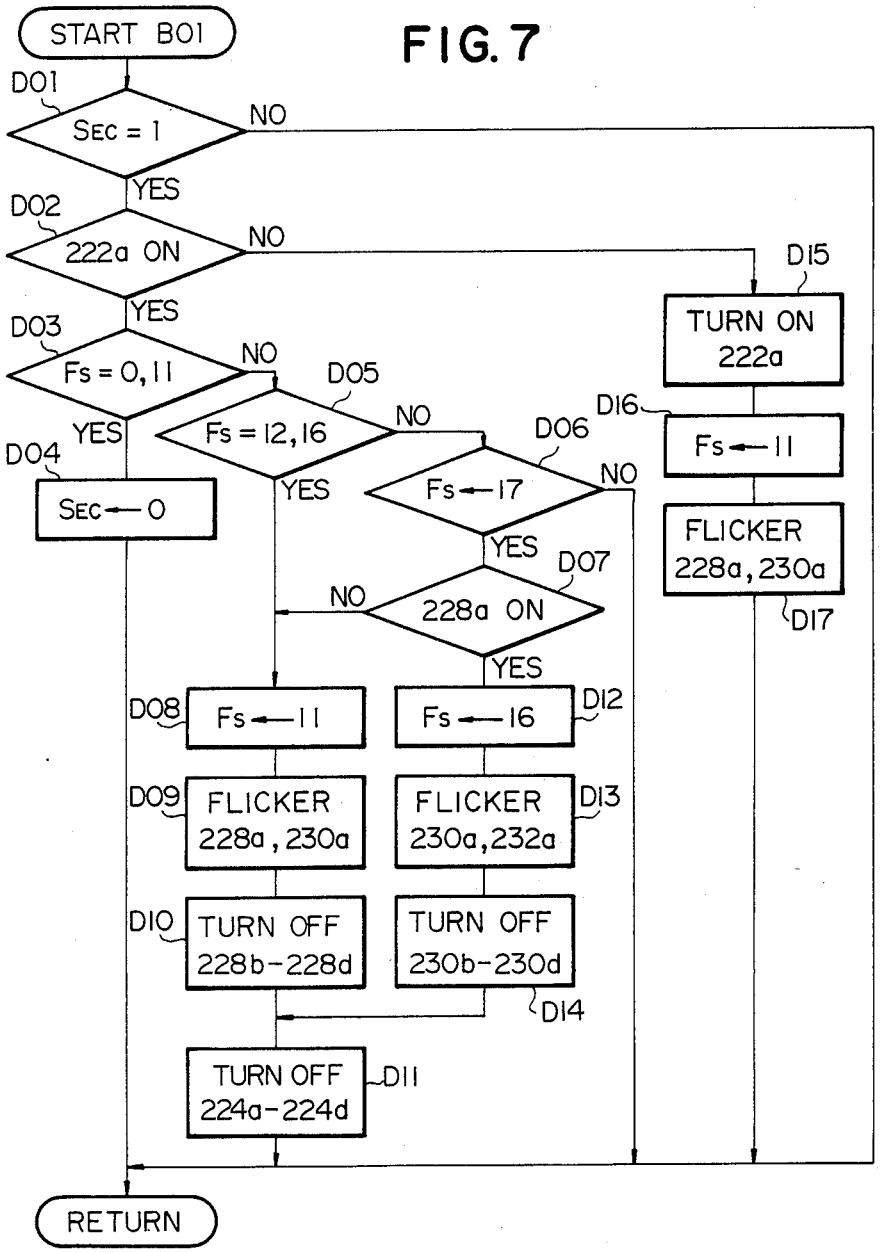
FIG. 7 is a flowchart showing an edited copy mode select subroutine program included in the routine program illustrated in FIG. 5.
Figure 8:
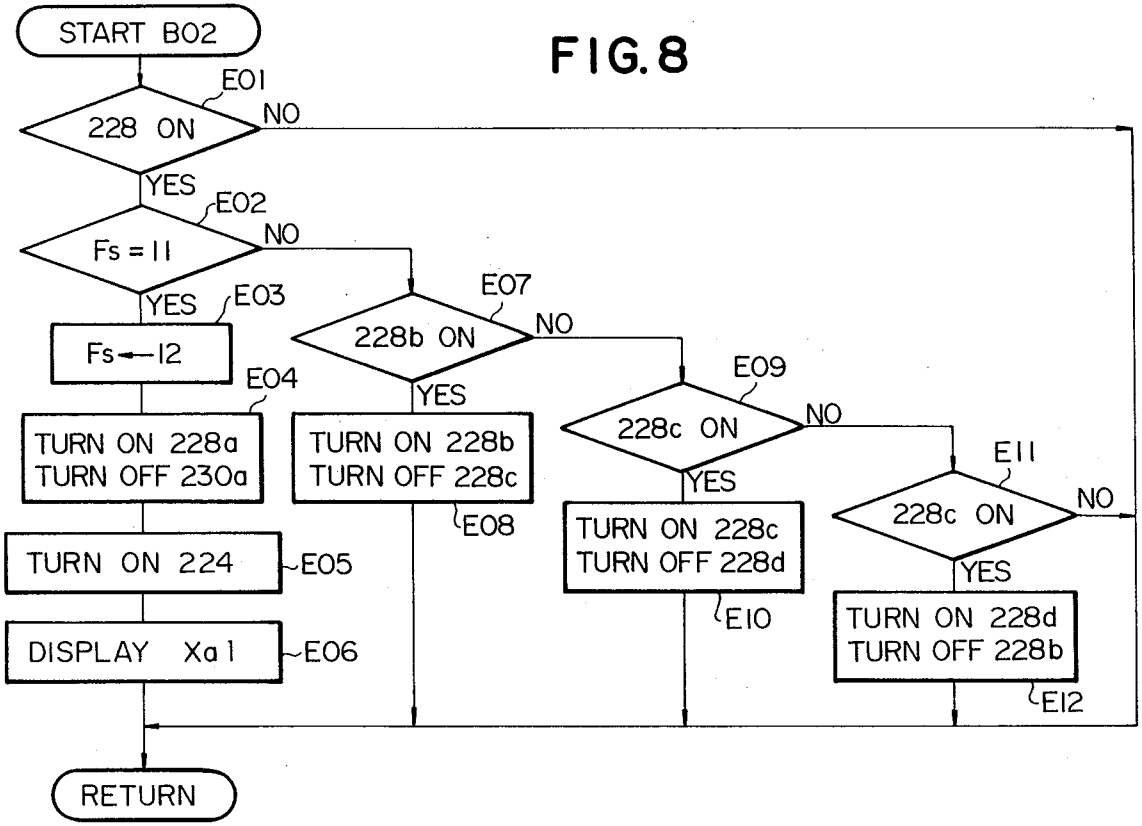
FIG. 8 is a flowchart showing an area 1 select subroutine program also included in the routine program illustrated in FIG. 5.
Figure 12:
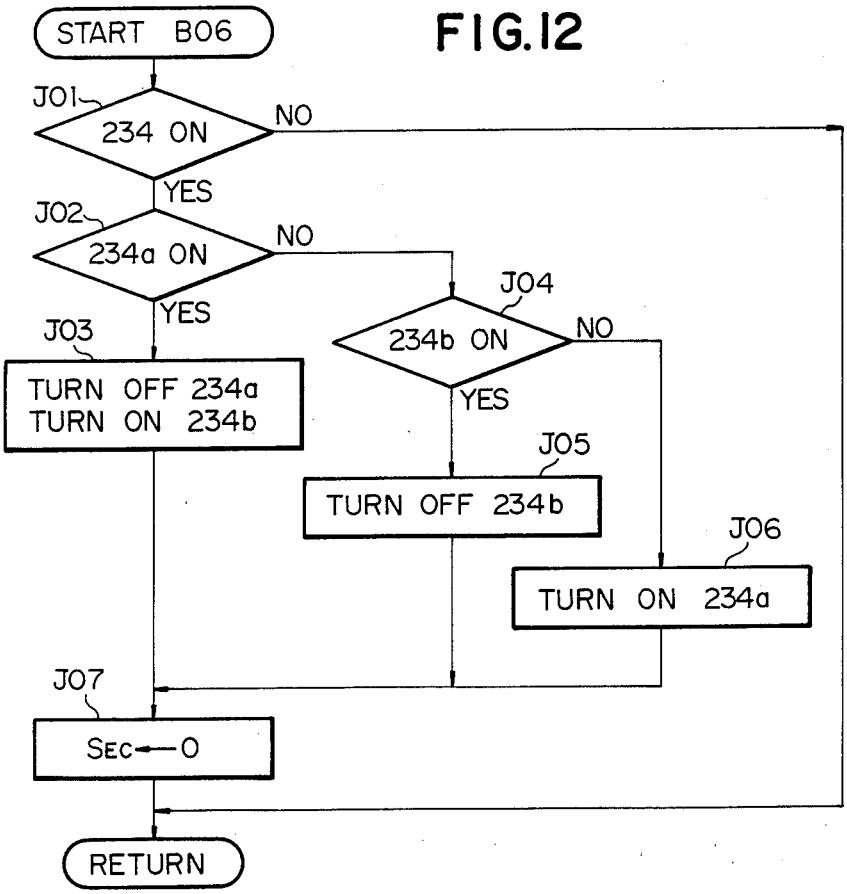
FIG. 12 is a flowchart showing a memory area select subroutine program also included in the routine program illustrated in FIG. 5.
Figure 13:
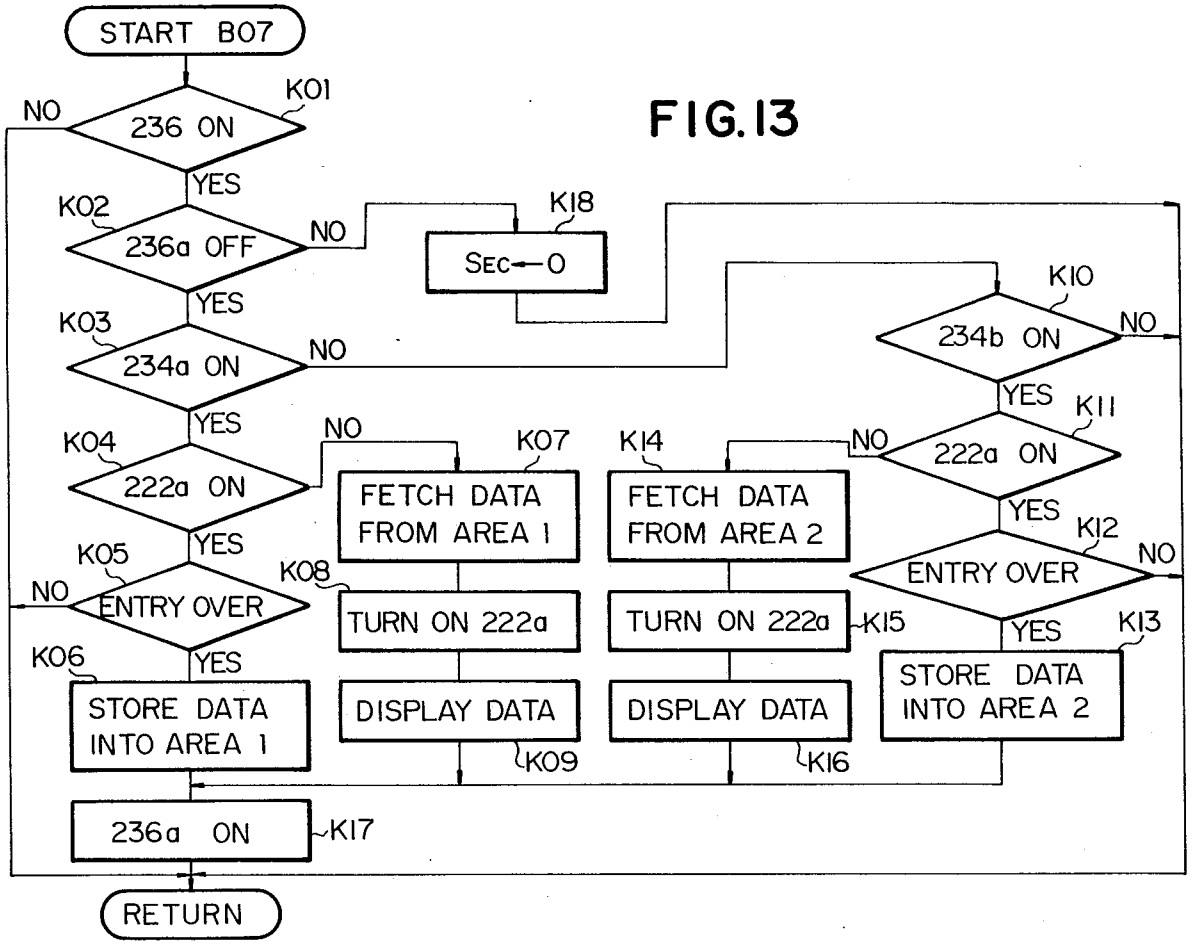
FIG. 13 is a flowchart showing an edited copy mode data storage subroutine program further included in the routine program illustrated in FIG. 5.

Turning to FIG. 5, the edited copy mode setting routine program A04 comprises a series of subroutine programs which consists of an edited copy mode setting subroutine program B01 (FIG. 7), an area 1 select subroutine program B02 (FIG. 8), an area 2 select subroutine program B03 (FIG. 9), an outside area select subroutine program B04 (FIG. 10), a coordinate data display subroutine program B05 (FIGS. 11A and 11B), a memory area select subroutine program B06 (FIG. 12), and an edited copy mode data storage subroutine program B07 (FIG. 13).

Before entering into detailed description of each of these subroutine programs B01 to B07, definitions will be given to state flags "00", "11", "12", "16" and "17" used in the edited copy mode setting routine program A04. These state flags are defined as follows:

| State Flag | Definition |
|---|---|
| "00" | Edited copy mode is not established or has terminated |
| "11" | Choose either the edited copy area 1 or the edited copy area 2 |
| "12" | Edited copy area 1 is being created |
| "16" | Choose either the edited copy area 2 or the outside area |
| "17" | Edited copy area 2 is being created |

Description will now be made in regard to the details of the data input routine program A03 included in the main routine program shown in FIG. 4. Prior to the start of the routine program A03, data are entered from the numerical switches 204 on the control panel 200, including those representative of the coordinates of each of the edited copy areas 1 and 2 and those indicative of the desired quantity of copy sheets to be printed for a single document sheet. In the description to follow, it is assumed that the data representative of the coordinates of the edited copy areas 1 and 2 include x-coordinates $X_{a1}$ and $X_{b1}$ and y-coordinates $Y_{c1}$ and $Y_{d1}$ defining the edited copy area 1 and x-coordinates $X_{a2}$ and $X_{b2}$ and y-coordinates $Y_{c2}$ and $Y_{d2}$ defining the edited copy area 2. These x- and y-coordinates respectively correspond to the x-coordinates $X_a$ and $X_b$ and y-coordinates $Y_c$ and $Y_d$ defining the edited copy area R shown displayed on the area display screen 226 on the control panel 200.

Data Input Routine (A03)

The data input routine program A03 is used to store into the memory 306 either the data representative of the x- and y-coordinates $X_{a1}$, $X_{b1}$, $Y_{c1}$ and $Y_{d1}$ of the edited copy area 1 and the x- and y-coordinates $X_{a2}$, $X_{b2}$, $Y_{c2}$ and $Y_{d2}$ of the edited copy area 2 or the data indicative of the desired quantity ($N_P$) of copy sheets to be printed for a single document sheet.

Figure 6A:
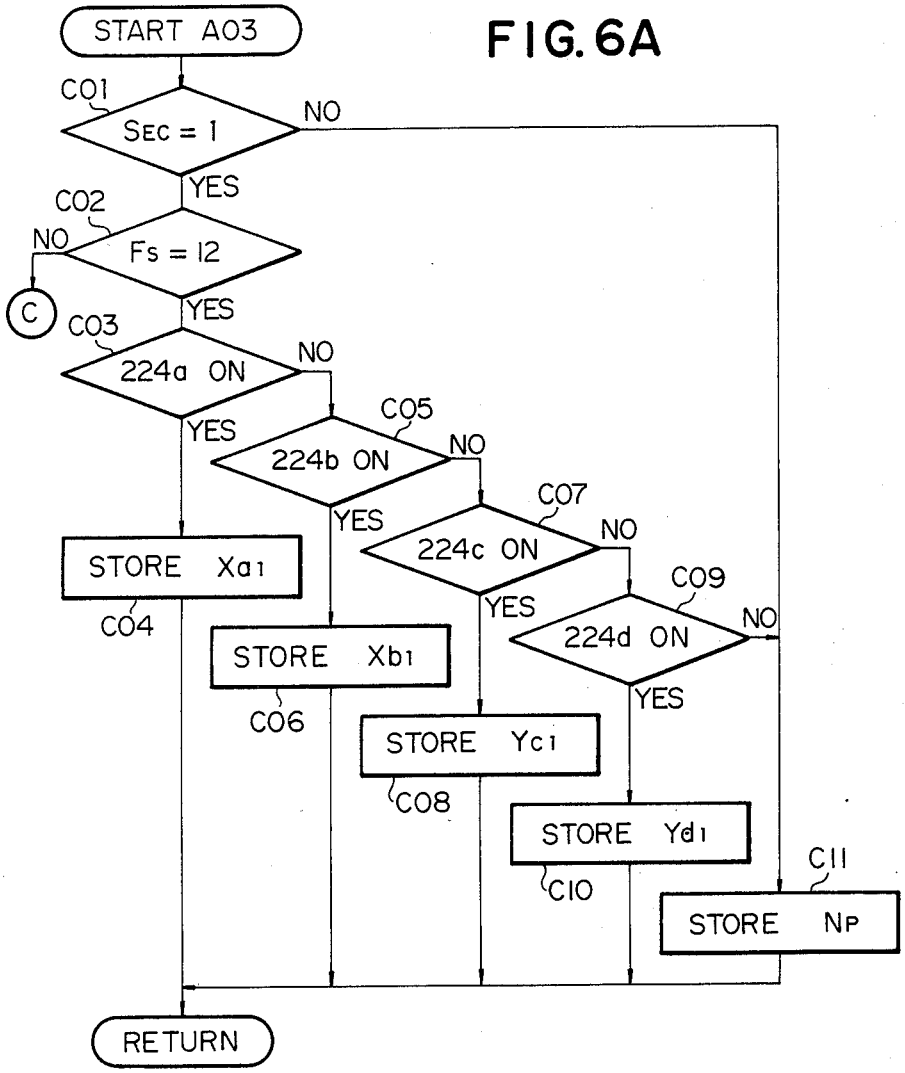
FIGS. 6A and 6B are flowcharts showing a data input subroutine program included in the main routine program illustrated in FIG. 4.
Figure 6B:
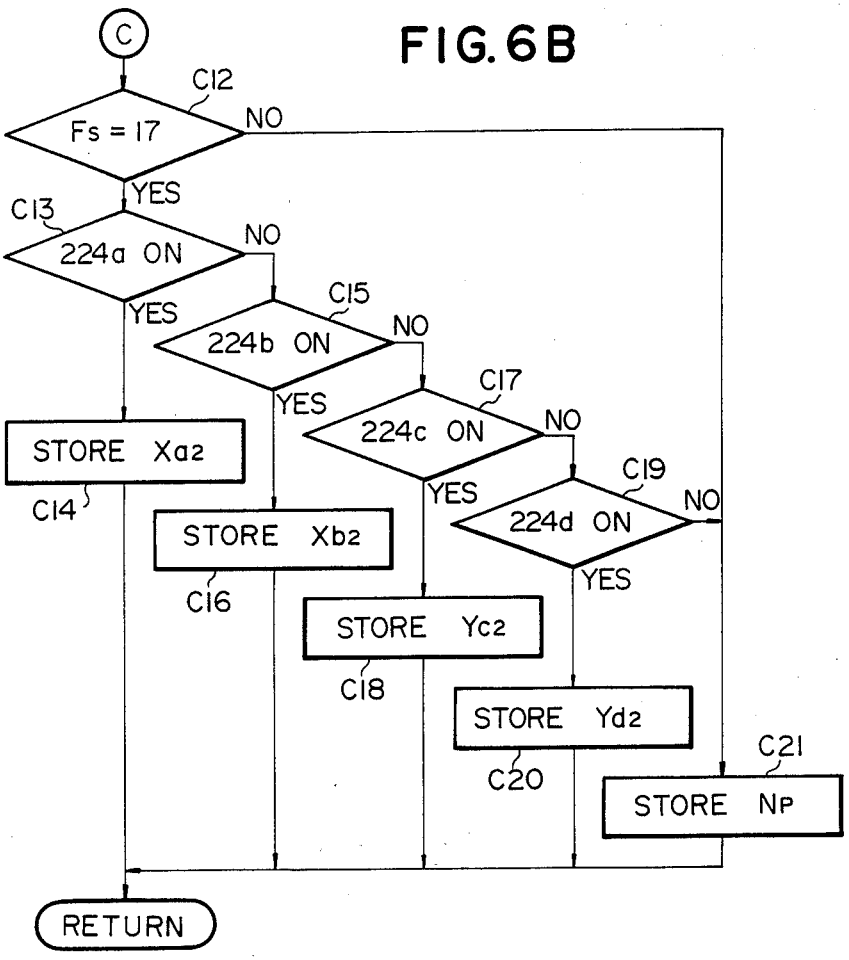

Referring to FIG. 6A and 6B, particularly first to FIG. 6A, the data input routine program A03 starts with a decision step C01 to determine whether or not the edited copy mode of operation is requested from the control panel 200. For this purpose, it is questioned whether or not the indicator 222*a* associated with the edited copy mode select switch 222 is turned on or, in other words, the edited copy mode request signal $S_{EC}$ from the switch 222 has a logic "1" bit flag. If it is determined that the indicator 222*a* is turned on with the edited copy mode request signal $S_{EC}$ having a logic "1" bit flag, it is further queried at a step C02 whether or not the state flag ($F_S$) currently present is indicative of a value "12", viz., the edited copy area 1 is being currently created If it is found that such a state flag is present, the system proceeds to steps C03 to C10 to store the data representative of the x- and y-coordinates $X_{a1}$, $X_{b1}$, $Y_{c1}$ and $Y_{d1}$ of the edited copy area 1. For this purpose, it is first detected at a step C03 whether or not the first coordinate indicator 224*a* associated with the area data enter switch 224 is turned on and, if the coordinate indicator 224*a* is found to be turned on, the data representative of one x-coordinate $X_{a1}$ for the area 1 is stored into the memory 306 at a step C04. If the first coordinate indicator 224*a* is found to be turned off at the step C03, it is detected at a step C05 whether or not the second coordinate indicator 224*b* associated with the switch 224 is turned on and, if the coordinate indicator 224*b* is found to be turned on, the data representative of the other x-coordinate $X_{b1}$ for the area 1 is stored into the memory 306 at a step C06. If the second coordinate indicator 224*b* is found to be turned off at the step C05, it is detected at a step C07 whether or not the third coordinate indicator 224*c* associated with the switch 224 is turned on and, if the coordinate indicator 224*c* is found to be turned on, the data representative of one y-coordinate $Y_{c1}$ for the area 1 is stored into the memory 306 at a step C08. If the third coordinate indicator 224*c* is found to be turned off at the step C07, it is detected at a step C09 whether or not the fourth coordinate indicator 224*d* associated with the switch 224 is turned on and, if the coordinate indicator 224*d* is found to be turned on, the data representative of the other y-coordinate $Y_{d1}$ for the area 1 is stored into the memory 306 at a step C10. In these manners, the x- and y-coordinates $X_{a1}$, $X_{b1}$, $Y_{c1}$ and $Y_{d1}$ of the edited copy area 1 are successively stored into the memory 306 and the rectangular area defined as the first edited copy area 1 by the coordinate points $P_1$ ($X_{a1}$, $Y_{c1}$, $P_2$ ($X_{b1}$, $Y_{c1}$, $P_3$ ($X_{a1}$, $Y_{d1}$) and $P_4$ ($X_{b1}$, $Y_{d1}$) is displayed on the area display screen 226 of the control panel 200. If, on the other hand, the indicator 222*a* associated with the edited copy mode select switch 222 is found to be turned off at the step C01 or if the third coordinate indicator 224*d* associated with the area data enter switch 224 is found to be turned off at the step C09, the system proceeds to a step C11 to store into the memory 306 the data indicative of the selected quantity $N_P$ of copy sheets to be printed.

If it is determined at the step C02 that the state flag is not indicative of the value "12", viz., the copy area 1 is not being created, the system proceeds via a connector "C" to a step C12 to confirm whether or not the state flag currently present is indicative of a value "17", viz., the edited copy area 2 is being currently created. If the answer for this decision step C12 is given in the affirmative, the system reiterates steps C13 to C21 to store into the memory 306 the data representative of the x- and y-coordinates $X_{a2}$, $X_{b2}$, $Y_{c2}$ and $Y_{d2}$ of the edited copy area 2 or the data indicative of the selected quantity $N_P$ of copy sheets to be printed.

FIGS. 7 to 13 show the details of the subroutine programs B01 to B07 of the edited copy mode setting routine program A04 shown in FIG. 4.

Edited Copy Mode Select Subroutine B01

By the edited copy mode select subroutine program B01 is established the edited copy mode of operation in the presence of the edited copy mode select signal $S_{EC}$ of a logic "1" bit flag. When it is confirmed at a step D01 that the flag bit of the signal $S_{EC}$ from the edited copy mode select switch 222 is shifted from a logic "0" state to a logic "1" bit state, it is questioned at a subsequent step D02 whether or not the indicator 222*a* associated with the switch 222 is turned on or, in other words, the edited copy mode request signal $S_{EC}$ from the switch 222 has a logic "1" bit flag. If it is determined that the indicator 222*a* is turned on with the edited copy mode request signal $S_{EC}$ having a logic "1" bit flag, it is further queried at a step D03 whether or not the state flag currently present is indicative of a value "00" or "11". If it is found at this step D03 that the current state flag is indicative of a value "00" or "11", viz., an edited copy mode is not established or has terminated or it is being requested to choose either the edited copy area 1 or 2, the flag bit of the edited copy mode select signal $S_{EC}$ is shifted to a logic "0" state at a step D04. If it is found at the step D03 that the state flag currently present is not indicative of the value "00" or "11", then it is further questioned at a step C05 whether or not the state flag is indicative of a value "12" or "16". If it is found at this step D05 that the current state flag is not indicative of a value "12" or "16", it is further tested at a step D06 whether or not the state flag is indicative of a value "17". When it is confirmed at this step D06 that the state flag is indicative of a value "17", it is detected at a step D07 whether or not the area-1 select indicator 228*a* associated with the area-1 data enter switch 228 is turned on.

If the area-1 select indicator 228*a* is found to be turned off at the step D07 or if the state flag is found to be indicative of a value "12" or "16" at the step D05 with the edited copy area 1 being created or with a choice requested for either the edited copy area 2 or the outside area, the state flag is shifted to a value "11" as at a step D08. Thereupon, the area-1 select indicator 228*a* and, in addition, the area-2 select indicator 230*a* associated with the area-2 data enter switch 230 are actuated to flicker at a step D09, which is followed by a step D10 at which all the remaining indicators 228*b*, 228*c* and 228*d* associated with the area-1 data enter switch 228 are turned off. All the coordinate indicators 224*a*, 224*b*, 224*c* and 224*d* associated with the area data enter switch 224 are then turned off at a subsequent step D11. If, on the other hand, the area-1 select indicator 228*a* is found to be turned on at the step D07, the state flag is shifted to a value "16" as at a step D12. Thereupon, the area-2 select indicator 230*a* associated with the area-2 data enter switch 230 and, in addition, the outside-area select indicator 232*a* associated with the outside-area data enter switch 232 are actuated to flicker at a step D13. The step D13 is followed by a step D14 at which all the remaining indicators 230*b*, 230*c* and 230*d* associated with the area-2 data enter switch 230 are turned off and then all the coordinate indicators 224*a*, 224*b*, 224*c* and 224*d* associated with the area data enter switch 224 are turned off at the step D11.

If it is found at the step D02 that the indicator 222*a* associated with the edited copy mode select switch 222 is turned off, the particular indicator 222*a* is actuated to turn on at a step D15 to permit the operator to enter the coordinate data for the edited copy area 1. Then the state flag is shifted to a value "11" at a step D16 to request a choice for the edited copy area 1 or 2. Thereupon, the area-1 and area-2 select indicators 228*a* and 230*a* associated with the area-1 and area-2 data enter switches 228 and 230, respectively, are actuated to flicker at a step D17.

Edited Copy Area 1 Select Subroutine B02

The edited copy area 1 select subroutine program B02 starts with a step E01 at which it is confirmed that there is an active signal produced with the area-1 data enter switch 228 depressed. It is further tested at a subsequent step E02 whether or not the state flag currently present is indicative of a value "11" requesting a choice for the edited copy area 1 or 2. If it is determined at this step E02 that the currently present state flag is indicative of a value "11", the state flag is shifted to a value "12" as at a step E03. Subsequently, the area-1 select indicator 228*a* associated with the area-1 data enter switch 228 is turned on and, in turn, the area-2 select indicator 230*a* associated with the area-2 data enter switch 230 is turned off at a step E04. In addition, the first coordinate indicator 224*a* associated with the area data enter switch 224 is turned on at a step E05 and, subsequently at a step E06, the numerical data indicative of one x-coordinate $X_{a1}$ for the edited copy area 1 is displayed on the numerical data display window 206 of the control panel 200.

On the other hand, if the state flag is found to be not indicative of the value "11" at the step E02, it is tested at a step E07 whether or not the black select indicator 228*b* associated with the area-1 data enter switch 228 is turned on. If the black select indicator 228*b* is found to be turned on at the step E07, the particular indicator 228*b* is turned off and, in turn, the red select indicator 228*c* associated with the switch 228 is turned on at a step E08. If the black select indicator 228*b* is found to be turned off at the step E07, it is tested at a step E09 whether or not the red select indicator 228*c* is turned on. If the red select indicator 228*c* is found to be turned on at the step E09, the particular indicator 228*c* is turned off and, in turn, the erase select indicator 228*d* associated with the switch 228 is turned on at a step E10. If the red select indicator 228*c* is found to be turned off at the step E09, it is tested at a step Ell whether or not the erase select indicator 228*d* is turned on. If the erase select indicator 228*d* is found to be turned on at the step E11, the particular indicator 228*d* is turned off and, in turn, the black select indicator 228*b* associated with the switch 228 is turned on at a step E12. Thus, the black, red and erase select indicators 228*b*, 228*c* *and* 228*d* associated with the area-1 data enter switch 228 are turned on recursively when any one of these indicators 228*b*, 228*c* and 228*d* is turned on in the presence of a signal produced with the area-1 data enter switch 228 depressed. It may be noted that if, at all, one of the black, red and erase select indicators 228*b*, 228*c* and 228*d* associated with the switch 228 is turned on, the area-1 data enter switch 228 can be depressed effectively even when coordinate data for the edited copy area 2 are being entered or after all the data for an intended edited copying mode of operation have been entered.

Edited Copy Area 2 Select Subroutine B03

Figure 9:
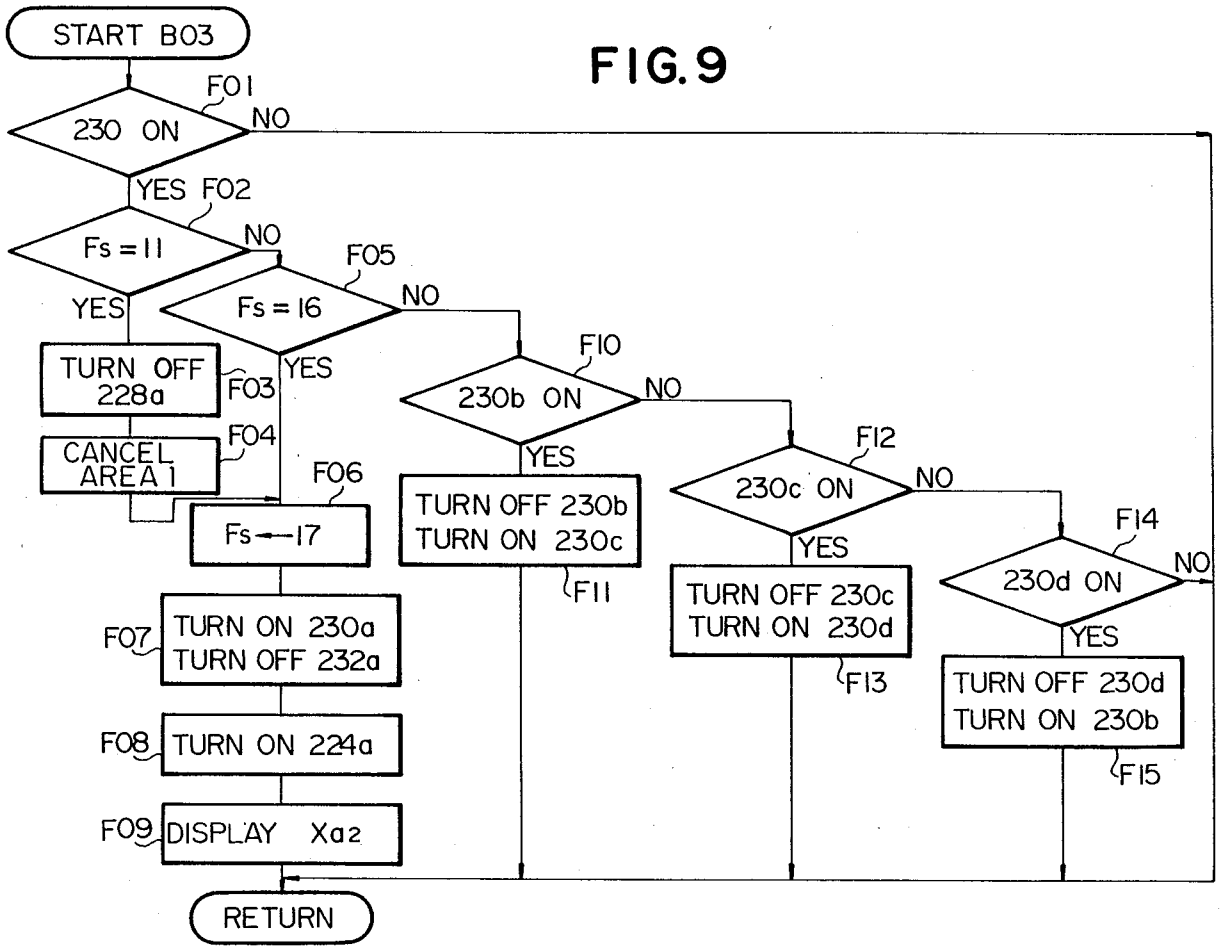
FIG. 9 is a flowchart showing an area 2 select subroutine program also included in the routine program illustrated in FIG. 5.

As shown in FIG. 9, the edited copy area 2 select subroutine program B03 starts with a step F01 at which it is confirmed that there is an active signal produced with the area-1 data enter switch 228 depressed. It is further tested at a subsequent step F02 whether or not the state flag currently present is indicative of a value "11" requesting a choice for the edited copy area 1 or 2. If it is determined at this step F02 that the currently present state flag is indicative of a value "11", the area-1 select indicator 228*a* associated with the switch 228 is turned off at a step F03 and thereafter the selection of the edited copy area 1 is cancelled at a step F04. If it is determined at the step F02 that the state flag is not indicative of a value "11", it is further tested at a step F05 whether or not the state flag is indicative of a value "16" requesting a choice for the edited copy area 2 or the outside area. If it is determined at this step F05 that the state flag is indicative of a value "16" or subsequently to the step F04, the state flag is shifted to a value "17" as at a step F06. The area-2 select indicator 230*a* associated with the area-2 data enter switch 230 is then turned on and, in turn, the outside area erase select indicator 232*a* associated with the outside-area data enter switch 232 is turned off at a step F07. In addition, the first coordinate indicator 224*a* associated with the area data enter switch 224 is turned on at a step F08 and, subsequently at a step F09, the numerical data indicative of one x-coordinate $X_{a2}$ for the edited copy area 2 is displayed on the numerical data display window 206 of the control panel 200.

On the other hand, if the state flag is found to be not indicative of the value "16" at the step F05, it is tested at a step F10 whether or not the black select indicator 230*b* associated with the area-2 data enter switch 230 is turned on. If the black select indicator 230*b* is found to be turned on at the step F10, the particular indicator 230*b* is turned off and, in turn, the red select indicator 230*c* associated with the switch 230 is turned on at a step F11. If the black select indicator 230*b* is found to be turned off at the step F10, it is tested at a step F12 whether or not the red select indicator 230*c* is turned on. If the red select indicator 230*c* is found to be turned on at the step F12, the particular indicator 230*c* is turned off and, in turn, the erase select indicator 230*d* associated with the switch 230 is turned on at a step F13. If the red select indicator 230*c* is found to be turned off at the step F12, it is tested at a step F14 whether or not the erase select indicator 230*d* is turned on. If the erase select indicator 230*d* is found to be turned on at the step F14, the particular indicator 230*d* is turned off and, in turn, the black select indicator 230*b* associated with the switch 230 is turned on at a step F15. Thus, the black, red and erase select indicators 230*b*, 230*c* *and* 230*d* associated with the area-2 data enter switch 230 are turned on recursively when any one of these indicators 230*b*, 230*c* and 230*d* is turned on in the presence of a signal produced with the area-2 data enter switch 230 depressed.

Outside Area Select Subroutine B04

Figure 10:
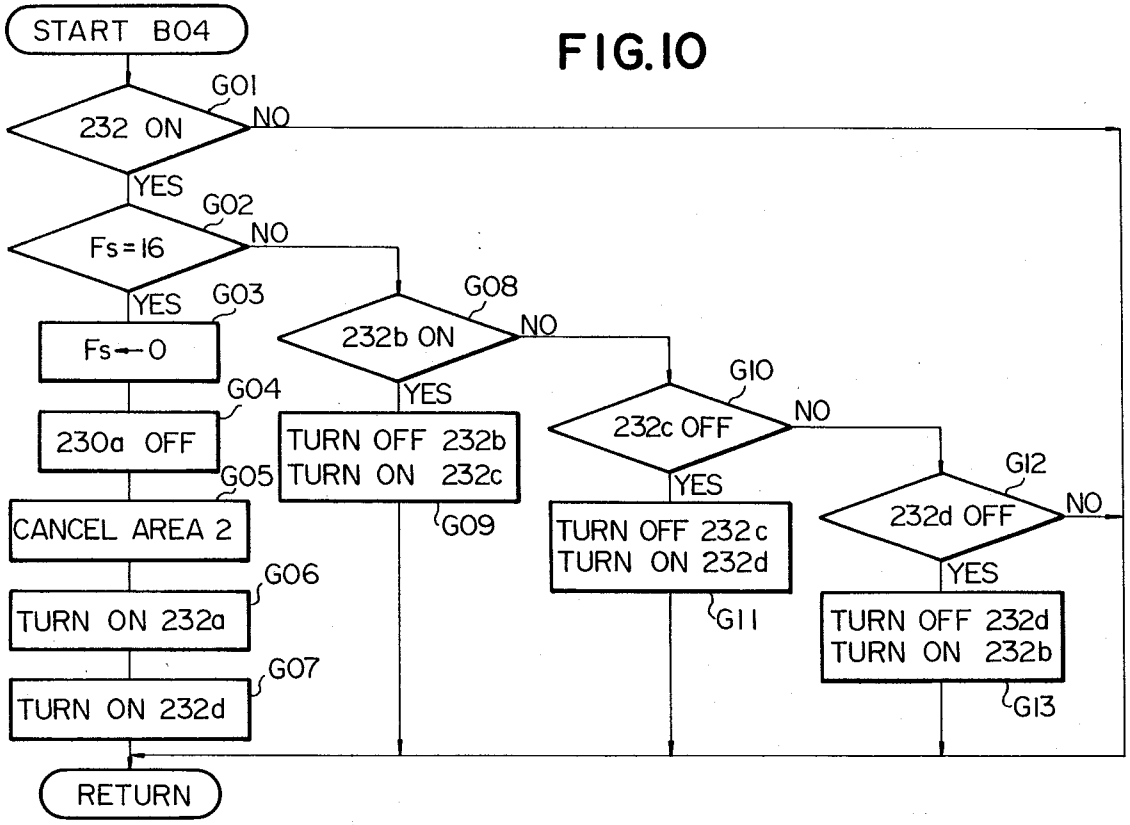
FIG. 10 is a flowchart showing an outside area select subroutine program further included in the routine program illustrated in FIG. 5.

Reverting to FIG. 10, the outside area select subroutine program B04 starts with a step G01 at which it is confirmed that there is an active signal produced with the outside-area data enter switch 232 depressed. It is further tested at a subsequent step G02 whether or not the state flag currently present is indicative of a value "16" requesting a choice for the edited copy area 2 or the outside area. If it is determined at this step G02 that the currently present state flag is indicative of a value "16", the state flag is shifted to a value "00" at a step G03 and, in addition, the area-2 select indicator 230*a* associated with the switch 230 is turned off at a step G04. Furthermore, the selection of the edited copy area 2 is cancelled at a step G05, whereupon the outside-area select indicator 232*a* and erase select indicator 232*d* associated with the outside-area data enter switch 232 are turned on at steps G06 and G07, respectively.

If it is determined at the step G02 that the state flag is not indicative of a value "16", it is tested at a step G08 whether or not the black select indicator 232b associated with the outside-area data enter switch 232 is turned on. If the black select indicator 232b is found to be turned on at the step G08, the particular indicator 232b is turned off and, in turn, the red select indicator 232c associated with the switch 232 is turned on at a step G09. If the black select indicator 232b is found to be turned off at the step G08, it is tested at a step G10 whether or not the red select indicator 232c is turned on. If the red select indicator 232c is found to be turned on at the step G10, the particular indicator 232c is turned off and, in turn, the erase select indicator 232d associated with the switch 232 is turned on at a step G11. If the red select indicator 232c is found to be turned off at the step G10, it is tested at a step G12 whether or not the erase select indicator 232d is turned on. If the erase select indicator 232d is found to be turned on at the step G12, the particular indicator 232d is turned off and, in turn, the black select indicator 232b associated with the switch 232 is turned on at a step G13. Thus, the black, red and erase select indicators 232b, 232c and 232d associated with the outside-area data enter switch 232 are turned on recursively when any one of these indicators 232b, 232c and 232d is turned on in the presence of a signal produced with the outside-area data enter switch 232 depressed.

Coordinate Data Enter Subroutine B05

The coordinate data display subroutine program B05 is used to read from the memory 306 the data representative of the x- and y-coordinate $X_{b1}$, $Y_{c1}$ and $Y_{d1}$ of the edited copy area 1 and the x- and y-coordinates $X_{b2}$, $Y_{c2}$ and $Y_{d2}$ of the edited copy area 2 and display the data on the numerical data display window 206.

Figure 11A:
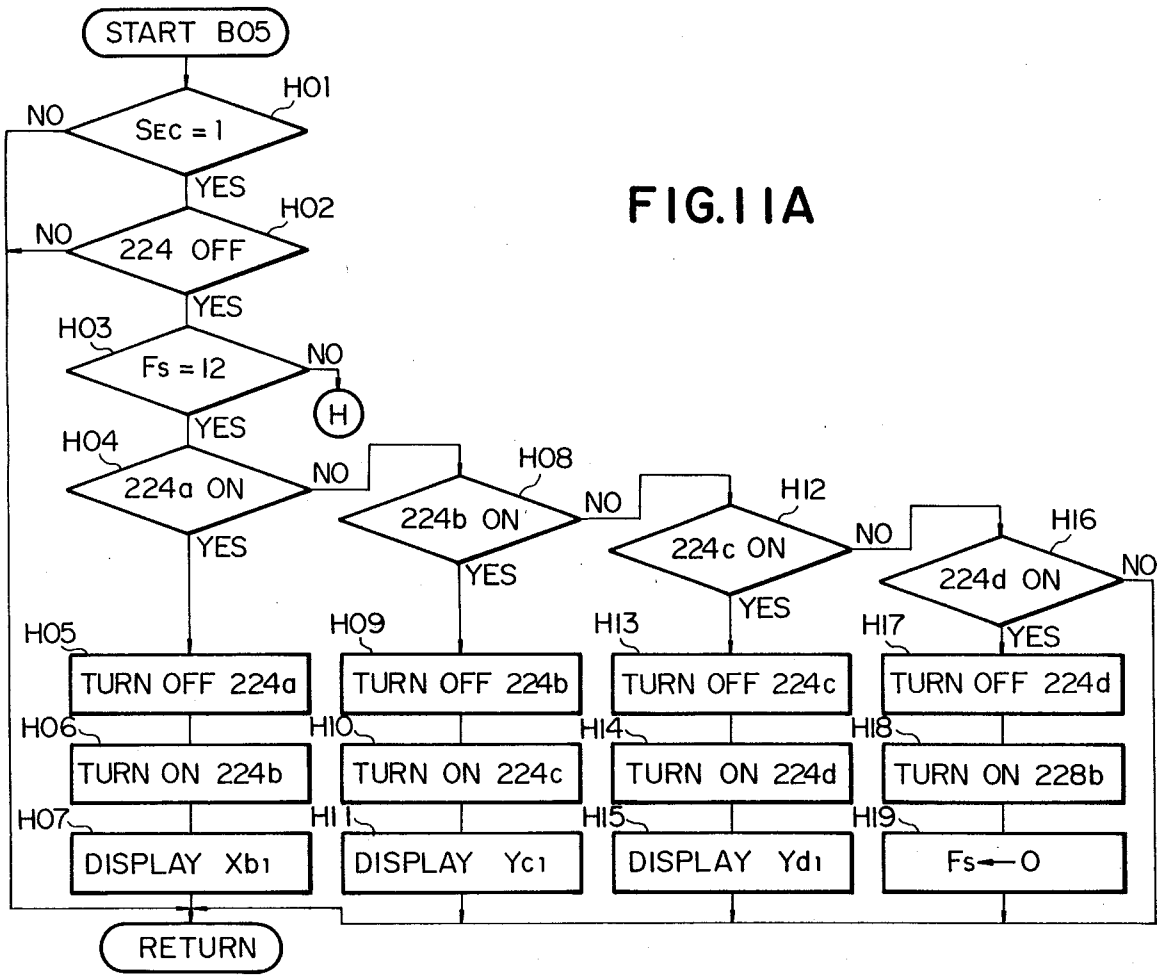
FIGS. 11A and 11B flowcharts showing a coordinate data display subroutine program further included in the routine program illustrated in FIG. 5.
Figure 11B:
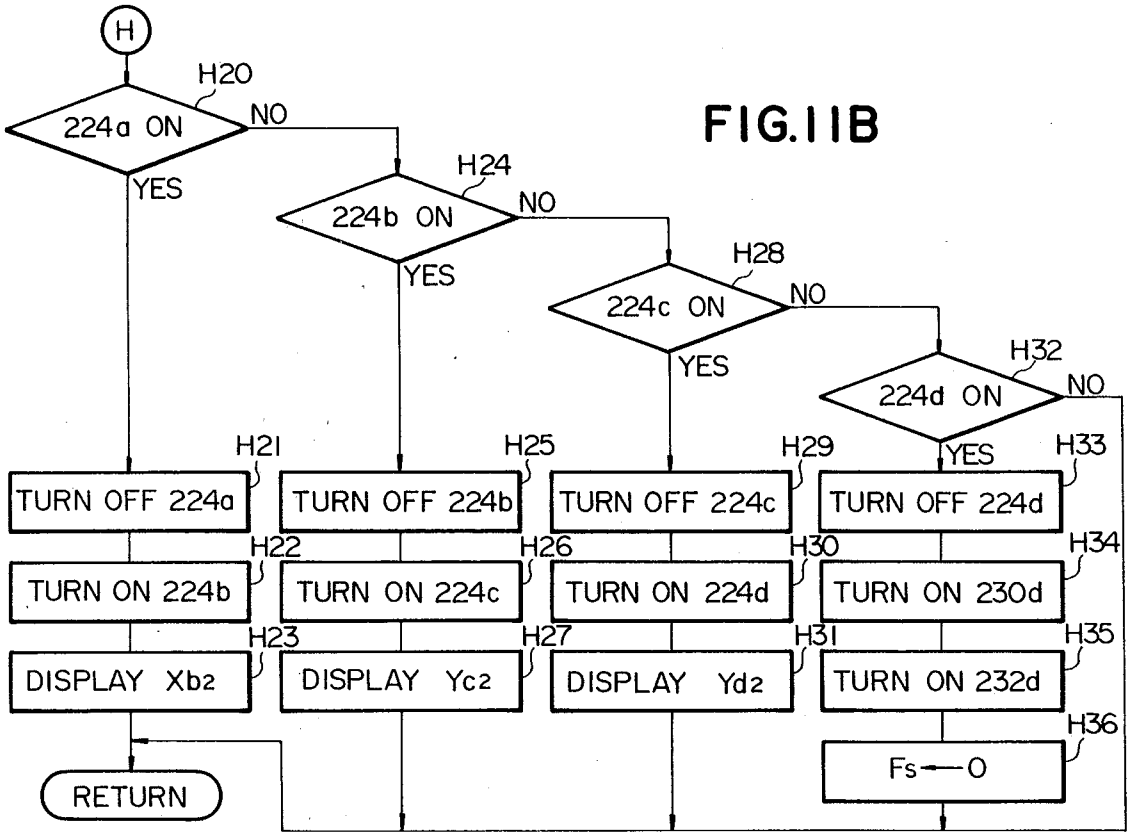

Referring to FIG. 11A and 11B, particularly first to FIG. 11A, the data display subroutine program B05 starts with a decision step H01 to determine whether or not the edited copy mode of operation is requested from the control panel 200. It is thus questioned at the step H01 whether or not the indicator 222a associated with the edited copy mode select switch 222 is turned on or, in other words, the edited copy mode request signal $S_{EC}$ from the switch 222 has a logic "1" bit flag. If it is determined that the indicator 222a is turned on with the edited copy mode request signal $S_{EC}$ having a logic "1" bit flag, it is further queried at a step H02 whether or not there is an active signal produced with the area data enter switch 224 depressed. In the presence of such a signal, it is then confirmed whether or not the state flag currently present is indicative of a value "12", viz., the edited copy area 1 is being currently created. If it is found that such a state flag is present, the system proceeds to steps H04 to H19 to display the data representative of the x- and y-coordinates $X_{b1}$, $Y_{c1}$ and $Y_{d1}$ of the edited copy area 1. For this purpose, it is first detected at a step H04 whether or not the first coordinate indicator 224a associated with the area data enter switch 224 is turned on and, if the coordinate indicator 224a is found to be turned on, the particular coordinate indicator 224a is turned off at a step H05 and, in turn, the second coordinate indicator 224b associated with the switch 224 is turned on at a step H06. The data representative of the x-coordinate $X_{a1}$ for the area 1 is then displayed on the numerical data display window 206 at a step H07. If the first coordinate indicator 224a is found to be turned off at the step H04, it is detected at a step H08 whether or not the second coordinate indicator 224b associated with the switch 224 is turned on and, if the coordinate indicator 224b is found to be turned on, the particular coordinate indicator 224b is turned off at a step H09 and, in turn, the third coordinate indicator 224c associated with the switch 224 is turned on at a step H10. The data representative of one y-coordinate $Y_{c1}$ for the area 1 is then displayed on the numerical data display window 206 at a step H11. If the second coordinate indicator 224b is found to be turned off at the step H08, it is detected at a step H12 whether or not the third coordinate indicator 224c associated with the switch 224 is turned on and, if the coordinate indicator 224c is found to be turned on, the particular coordinate indicator 224c is turned off at a step H13 and, in turn, the fourth coordinate indicator 224d associated with the switch 224 is turned on at a step H14. The data representative of the other y-coordinate $Y_{d1}$ for the area 1 is then displayed on the numerical data display window 206 at a step H15. If the third coordinate indicator 224c is found to be turned off at the step H12, it is detected at a step H16 whether or not the fourth coordinate indicator 224d associated with the switch 224 is turned on and, if the coordinate indicator 224d is found to be turned on, the particular coordinate indicator 224d is turned off at a step H17 and, in turn, the black select indicator 228b associated with the area-1 data enter switch 228 is turned on at a step H18. With the state flag shifted to a value "12" at a step H19 thereafter, the system recycles to the edited copy mode setting subroutine. In these manners, the x- and y-coordinates $X_{b1}$, $Y_{c1}$ and $Y_{d1}$ of the edited copy area 1 are successively displayed on the numerical data display window 206 and the rectangular area defined as the first edited copy area 1 by the coordinate points $P_1$ ($X_{a1}$, $Y_{c1}$), $P_2$ ($X_{b1}$, $Y_{c1}$), $P_3$ ($X_{a1}$, $Y_{d1}$) and $P_4$ ($X_{b1}$, $Y_{d1}$) is displayed on the area display screen 226 of the control panel 200.

If it is determined at the step H03 that the state flag is not indicative of the value "12", viz., the copy area: 1 is not being created, the system proceeds via a connector "H" to steps H20 to H31 shown in FIG. 11B to display on the numerical data display window 206 the data representative of the x- and y-coordinates $X_{b2}$, $Y_{c2}$ and $Y_{d2}$ of the edited copy area 2. If the third coordinate indicator 224c is found to be turned off at the step H28, it is detected at a step H32 whether or not &he fourth coordinate indicator 224d associated with the switch 224 is turned on and, if the coordinate indicator 224d is found to be turned on, the particular coordinate indicator 224d is turned off at a step H33 and, in turn, the black select indicator 230b associated with the area-2 data enter switch 230 is turned on at a step H34 while the erase select indicator 232d associated with the outside-area data enter switch 232 is turned on at a step H35. If the outside area data enter switch 232 is depressed after the coordinate data have been entered in the outside-area select subroutine program B04 as hereinbefore described, it is preset at the step G07 in FIG. 10 to erase the images within the outside area surrounding the area 1. This is required in consideration of the fact that the edited mode of copying operation to erase the area surrounding a desired edited copy area is used frequently and will contribute to the saving of time for copying operation since such a mode of copying operation is initially set up by default rules. Such a consideration is also given in connection with the memory area select subroutine program B06 in which, when the entry of the coordinate data specifying the area 1 or area 2 is complete, black is preferentially selected as the print color to be used for the area 1 or area 2 to save time for copying operation. With the state flag shifted to a value "00" at a step H36 thereafter, the system recycles to the step H01.

Memory Area Select Subroutine (B06)

Referring to FIG. 12, the memory area select subroutine program B06 starts with a decision step J01 to see if there is an active signal produced with the memory area select switch 234 depressed. In the presence of such a signal, it is confirmed at a step J02 whether or not the memory-1 select indicator 234*a* associated with the memory area select switch 234 is turned on. If it is found that the memory-1 select indicator 234*a* is turned on, the particular indicator 234*a* is turned off and, in turn, the memory-2 select indicator 234*b* associated with the switch 234 is turned on at a step J03. If it is found at the step J02 that the memory-1 select indicator 234*a* is turned off, it is confirmed at a step J04 whether or not the memory-2 select indicator 234*b* is turned on. If it is found at the step J04 that the memory-2 select indicator 234*b* is turned on, the indicator 234*b* is turned off at a step J05. If it is found at the step J04 that the memory-2 select indicator 234*b* is turned off, the particular indicator 234*a* is turned on at a step J06. After each of the memory-1 and memory-2 select indicators 234*a* and 234*b* associated with the memory area select switch 231 has thus been turned on or off at any of the steps J03, J05 and J06, the flag bit of the edited copy mode request signal $S_{EC}$ is shifted to a logic "0" state at a step J07 and then the system recycles to the edited copy mode subroutine. Thus, in the presence of an active signal produced with the memory area select switch 234 depressed, three different states consisting of the state selecting the memory area 1 of the random-access memory 306, the state selecting the memory area 2 of the memory 306, and the state selecting none of the memory areas 1 and 2 of the memory 306 are put into effect recursively by the memory area select subroutine program B06.

Edited Copy Mode Data Storage Subroutine (B07)

Referring to FIG. 13, the edited copy mode data storage subroutine program B07 starts with a step K01 to confirm where or not there is an active signal produced with the edited copy mode data memory switch 236 depressed. In the presence of such a signal, it is further confirmed at a step K02 whether or not the indicator 236*a* associated with the switch 236 is turned off. If it is found that the indicator 236*a* is turned off, it is tested at a step K03 whether or not the memory-1 select indicator 234*a* associated with the memory select switch 234 is turned on. If it is found that the indicator 234*a* is turned on, it is further detected at a step K04 whether or not the indicator 222*a* associated with the edited copy mode select switch 222 is turned on. If the indicator 222*a* is found to be turned on, it is queried at a step K05 whether or not all the data required for the intended edited mode of copying operation have completely been entered. If the answer for this decision step K05 is given in the affirmative, then the data entered are stored into the memory area 1 of the random-access memory 306 at a step K06. If it is found at the step K04 that the indicator 222*a* associated with the edited copy mode select switch 222 is turned off, then the data which have already been stored in the memory area 1 of the memory 306 are fetched at a step K07. The indicator 222*a* associated with the edited copy mode select switch 222 is then turned on at a step K08 so that an edited copying mode of operation is established automatically when the edited copy mode data memory switch 236 is turned on during ordinary mode of copying operation. The step K08 is followed by a step K09 to display the data indicating the printing color included in the data fetched from the memory area 1 of the memory 306.

If it is found at the step K03 that the memory-1 select indicator 234*a* associated with the memory select switch 234 is turned off, it is detected at a step K10 whether or not the memory-2 select indicator 234*b* associated with the switch 234 is turned on. If it is found at the step K10 that the memory-2 select indicator 234*b* is turned on, it is tested at a step K11 whether or not the indicator 222*a* associated with the edited copy mode select switch 222 is turned on. If the indicator 222*a* is found to be turned on, it is queried at a step K12 whether or not all the data required for the intended edited mode of copying operation have completely been entered. If the answer for this decision step K12 is given in the affirmative, then the data entered are stored into the memory area 2 of the memory 306 at a step K13. If it is found at the step K11 that the indicator 222*a* associated with the edited copy mode select switch 222 is turned off, then the data which have already been stored in the memory area 2 of the memory 306 are fetched at a step K14. After the indicator 222*a* associated with the edited copy mode select switch 222 is then turned on at a step K15 for the same reason as has been described, the data indicating the printing color included in the data fetched from the memory area 2 are displayed at a step K16. Subsequently to the data storage or display step K06, K09, K13 or K16, the indicator 236*a* associated with the edited copy mode data memory switch 236 is turned on at a step K17 whereupon the system recycles to the main routine program. If, on the other hand, the indicator 236*a* associated with the switch 236 is found to be turned on at the step K02, the flag bit of the edited copy mode request signal $S_{EC1}$ is shifted to a logic "0" state at a step K18 and thereupon the system also recycles to the main routine program.

What is claimed is:

1. An image duplicating apparatus having an edited mode of copying operation, comprising
   (a) image forming means for producing an edited copy of a given image;
   (b) mode selecting means for selecting said edited mode of copying operation;
   (c) area designating means for designating an edited copy area in which images are to be copied in the edited mode of copying operation;
   (d) data input means for entering data indicative of particulars in accordance with which said edited mode of copying operation is to be executed for the designated edited copy area; and
   control means for allowing entry of data from said data input means in any desired manner after said edited copy area has been designated by said area designating means, provided said edited mode of copying operation is selected.

2. An image duplicating apparatus as set forth in claim 1, in which said control means is operative to allow said data input means to enter data effective to alter the data which has once been entered.

3. An image duplicating apparatus as set forth in claim 2, in which said particulars in accordance with which said edited mode of copying operation is to be executed include those relating to a printing color to be used for the edited mode of copying operation.

4. An image duplicating apparatus as set forth in claim 2, in which said particulars in accordance with which said edited mode of copying operation is to be executed include those indicating whether or not the images in said edited copy area are to be erased.

5. An image duplicating apparatus as set forth in claim 2, in which said area designating means comprises (c/1) means for entering coordinate data specifying said edited copy area, (c/2) means for visually displaying said coordinate data, and c/3) memory means for storing said coordinate data, said control means being operative to allow entry of data from said data input means after said coordinate data has been stored into said memory means.

6. An image duplicating apparatus as set forth in claim 2, in which said area designating means is capable of designating a plurality of edited copy areas and in which said control means is operative to control entry of data from said data input means for each of said plurality of edited copy areas.

7. An image duplicating apparatus having an edited mode of copying operation, comprising (a) image forming means for producing an edited copy of a given image;

(b) area designating means for designating an edited copy area in which images are to be copied in the edited mode of copying operation;

(c) preset means for presetting particulars in accordance with which said edited mode of copying operation is to be executed for the designated edited copy area, said preset means presetting said particulars under the edited mode of copying operation; and (d) data input means for entering data indicative of desired particulars in accordance with which said edited mode of copying operation is to be executed for the designated edited copy area, (e) wherein said desired particulars may be different from the preset particulars and may be changed by said data input means from said preset particulars to said desired particulars for said designated edited copy area.

8. An image duplicating apparatus as set forth in claim 7, in which said preset means is operative to preset said particulars posterior to designation of said edited copy area by said area designating means.

9. An image duplicating apparatus as set forth in claim 7, in which said particulars in accordance with which said edited mode of copying operation is to be executed include those indicated by data relating to a printing color to be used for the edited mode of copying operation.

10. An image duplicating apparatus as set forth in claim 9, in which said preset particulars include those indicating that black is to be used as said printing color.

11. An image duplicating apparatus as set forth in claim 7, in which said particulars entered from said data input means include those indicating whether or not the images in said edited copy area are to be erased.

12. An image duplicating apparatus as set forth in claim 11, in which said particulars preset by said preset means include those indicating that the images outside said edited copy area are to be erased.

13. An image duplicating apparatus as set forth in claim 7, in which said area designating means is capable of designating a plurality of edited copy areas and in which said preset means is operative to preset said particulars for each of said plurality of edited copy areas after the edited copy areas have been designated by said area designating means.

14. An image duplicating apparatus as set forth in claim 13, in which said particulars preset by said preset means include those indicating that the images outside said edited copy area are to be erased, wherein the particulars indicating that the images outside said edited copy area are to be erased are preset by said preset means after said plurality of edited copy areas have been designated.

15. An image duplicating apparatus having an ordinary mode of copying operation and an edited mode of copying operation, comprising (a) image forming means for producing an edited copy of a given image;

(b) mode selecting means for selecting said edited mode of copying operation;

(c) data input means for entering the data indicative of particulars in accordance with which said edited mode of copying operating is to be executed:

(d) display means for visually displaying the data entered from said data input means;

(e) memory means for storing the data entered from said data input means; and (f) instruction input means having a first state when activated during said edited mode of copying operation and a second state the activated during said ordinary mode of copying operation, said instruction input means in said first state being operative to cause said memory means to store the data entered by said data input means and in said second state being operative to produce an instruction to select said edited mode of copying operation independently of said mode selecting means and an instruction to fetch said data from said memory means and display the fetched data on said display means.

16. An image duplicating apparatus as set forth in claim 15, in which said data to be entered from said data input means include those specifying the area within which images are to be duplicated in said edited mode of copying operation.

17. An image duplicating apparatus as set forth in claim 15, in which said particulars in accordance with which said edited mode of copying operation is to be executed include those relating to a printing color to be used for the edited mode of copying operation.

* * * * *